US011069297B2

(12) United States Patent
Qing

(10) Patent No.: US 11,069,297 B2
(45) **Date of Patent: *Jul. 20, 2021**

(54) PIXEL CIRCUIT AND METHOD OF DRIVING THE SAME, DISPLAY PANEL, AND DISPLAY APPARATUS

(71) Applicants: CHENGDU BOE OPTOELECTRONICS TECHNOLOGY CO., LTD., Sichuan (CN); BOE TECHNOLOGY GROUP CO., LTD., Beijing (CN)

(72) Inventor: Haigang Qing, Beijing (CN)

(73) Assignees: CHENGDU BOE OPTOELECTRONICS TECHNOLOGY CO., LTD., Sichuan (CN); BOE TECHNOLOGY GROUP CO., LTD., Beijing (CN)

( * ) Notice: Subject to any disclaimer, the term of this patent is extended or adjusted under 35 U.S.C. 154(b) by 0 days.

This patent is subject to a terminal disclaimer.

(21) Appl. No.: 16/704,234

(22) Filed: Dec. 5, 2019

(65) Prior Publication Data

US 2020/0105193 A1 Apr. 2, 2020

Related U.S. Application Data

(63) Continuation-in-part of application No. 16/457,868, filed on Jun. 28, 2019, now Pat. No. 10,923,032.

(30) Foreign Application Priority Data

Jul. 27, 2018 (CN) ..... 201810848372.8

(51) Int. Cl.
*G09G 3/3233* (2016.01)
*G09G 3/3258* (2016.01)
(Continued)

(52) U.S. Cl.
CPC ..... *G09G 3/3258* (2013.01); *G09G 3/3233* (2013.01); *G09G 3/3266* (2013.01);
(Continued)

(58) Field of Classification Search
CPC .. G09G 3/3258; G09G 3/3233; G09G 3/3266; G09G 3/3275; G09G 3/32;
(Continued)

(56) References Cited

U.S. PATENT DOCUMENTS 9,524,670 B2 * 12/2016 Park ..... G09G 3/3233
10,373,563 B2 * 8/2019 Park ..... G09G 3/3266
(Continued)

FOREIGN PATENT DOCUMENTS

CN 103440843 A 12/2013
CN 105096826 A 11/2015
(Continued)

OTHER PUBLICATIONS

Non-Final Office Action issued in related U.S. Appl. No. 16/457,868, dated Aug. 6, 2020.
(Continued)

*Primary Examiner* — Jose R Soto Lopez
(74) *Attorney, Agent, or Firm* — McDermott Will and Emery LLP

(57) ABSTRACT

A pixel circuit includes a writing sub-circuit, a driving sub-circuit, a compensation sub-circuit, and a light-emitting control sub-circuit. The writing sub-circuit is configured to write a data signal to the driving sub-circuit in response to a scanning signal. The compensation sub-circuit is configured to compensate the driving sub-circuit for a threshold voltage in response to the scanning signal. The light-emitting control sub-circuit is configured to turn on a circuit between a first voltage terminal and a second voltage terminal in response to a light-emitting signal. The driving
(Continued)

sub-circuit is configured to drive the light-emitting device to emit light according to the written data signal.

15 Claims, 12 Drawing Sheets

(51) Int. Cl.
*G09G 3/3266* (2016.01)
*G09G 3/3275* (2016.01)
*G09G 3/32* (2016.01)

(52) U.S. Cl.
CPC ..... *G09G 3/3275* (2013.01); *G09G 3/32* (2013.01); *G09G 2300/0426* (2013.01); *G09G 2300/0439* (2013.01); *G09G 2310/0243* (2013.01); *G09G 2320/0233* (2013.01)

(58) Field of Classification Search
CPC ... G09G 2310/0243; G09G 2320/0233; G09G 2300/0426; G09G 2300/0439; G09G 2310/0251; G09G 2300/0861; G09G 2300/0819; G09G 2300/0842; G09G 3/3291
See application file for complete search history.

(56) References Cited

U.S. PATENT DOCUMENTS 10,431,153 B2 * 10/2019 Gao ..... G09G 3/3233
2005/0110730 A1 * 5/2005 Kim ..... G09G 3/3233 345/82
2006/0022605 A1 * 2/2006 Ha ..... G09G 3/3233 315/169.3
2006/0066532 A1 * 3/2006 Jeong ..... G09G 3/3233 345/76
2010/0328365 A1 * 12/2010 Ikeda ..... G09G 3/3233 345/690
2011/0090200 A1 * 4/2011 Choi ..... G09G 3/3233 345/211
2011/0109598 A1 * 5/2011 Oh ..... G09G 3/3233 345/204
2011/0164071 A1 * 7/2011 Chung ..... G09G 3/3233 345/690
2013/0201172 A1 * 8/2013 Jeong ..... G09G 3/3258 345/212
2013/0249883 A1 * 9/2013 Hwang ..... G09G 3/3275 345/212
2015/0187275 A1 * 7/2015 Park ..... G09G 3/3258 345/690
2015/0221252 A1 * 8/2015 Qing ..... G09G 3/3291 345/76
2016/0351122 A1 * 12/2016 Jung ..... G09G 3/2085
2017/0178569 A1 * 6/2017 Hu ..... G09G 3/3266
2017/0337877 A1 * 11/2017 Kim ..... G09G 3/3225
2018/0069190 A1 * 3/2018 Kim ..... H01L 27/3262
2019/0348491 A1 * 11/2019 Chung ..... H01L 27/3276
2020/0006446 A1 * 1/2020 Lee ..... H01L 27/3276
2020/0082762 A1 * 3/2020 Takasugi ..... G09G 3/003

FOREIGN PATENT DOCUMENTS

CN 106504702 A 3/2017
CN 108269531 A 7/2018

OTHER PUBLICATIONS

First Office Action issued in Chinese Application No. 201810848372.8, dated Nov. 1, 2019, with English translation.
Notice of Allowance issued in U.S. Appl. No. 16/457,868, dated Nov. 25, 2020.
Notification of the Third Office Action issued in Chinese Patent Application No. 201810848372.8, dated Dec. 2, 2020; with English translation.

* cited by examiner

PIXEL CIRCUIT AND METHOD OF DRIVING THE SAME, DISPLAY PANEL, AND DISPLAY APPARATUS

CROSS-REFERENCE TO RELATED APPLICATION

This application is a continuation-in-part application of the U.S. patent application Ser. No. 16/457,868, filed on Jun. 28, 2019, which claims priority to Chinese Application No. 201810848372.8, filed Jul. 27, 2018, the entire disclosures of which are incorporated by reference herein in its entirety for all purposes.

TECHNICAL FIELD

The present disclosure relates to the field of display technologies, and in particular, to a pixel circuit and a method of driving the same, a display panel, and a display apparatus.

BACKGROUND

An organic light-emitting diode (OLED) display apparatus is increasingly used in high-performance display field due to its small size, low power consumption, no radiation, and relatively low manufacturing cost.

SUMMARY

In an aspect, a pixel circuit is provided. The pixel circuit includes a writing sub-circuit, a driving sub-circuit, a compensation sub-circuit, and a light-emitting control sub-circuit. The writing sub-circuit is electrically connected to a data signal terminal, a scanning signal terminal, and the driving sub-circuit, and is configured to write a data signal from the data signal terminal to the driving sub-circuit in response to a scanning signal from the scanning signal terminal. The compensation sub-circuit is electrically connected to the scanning signal terminal and the driving sub-circuit, and is configured to compensate the driving sub-circuit for a threshold voltage in response to the scanning signal. The light-emitting control sub-circuit is electrically connected to a light-emitting signal terminal and a second voltage terminal, and is electrically connected to a first voltage terminal through a light-emitting device. The light-emitting control sub-circuit is configured to turn on a circuit between the first voltage terminal and the second voltage terminal in response to a light-emitting signal from the light-emitting signal terminal. The driving sub-circuit is electrically connected to the light-emitting control sub-circuit and the light-emitting device, and is configured to drive the light-emitting device to emit light according to a written data signal.

In some embodiments, the pixel circuit further includes an initialization sub-circuit. The initialization sub-circuit is electrically connected to a first reset signal terminal, a second reset signal terminal, an initialization voltage terminal, the second voltage terminal, the driving sub-circuit, and the light-emitting device. The initialization sub-circuit is configured to transmit an initialization voltage signal from the initialization voltage terminal to the driving sub-circuit and the light-emitting device in response to a first reset signal from the first reset signal terminal, and to transmit a second voltage signal from the second voltage terminal to the driving sub-circuit in response to a second reset signal from the second reset signal terminal.

In some embodiments, the initialization sub-circuit is configured to receive an initialization voltage signal which is from the initialization voltage terminal and has a voltage equal to or approximately equal to a voltage of a first voltage signal from.

In some embodiments, the initialization sub-circuit includes a first transistor and a second transistor. A control electrode of the first transistor is electrically connected to the first reset signal terminal, a first electrode of the first transistor is electrically connected to the initialization voltage terminal, and a second electrode of the first transistor is electrically connected to the driving sub-circuit and a cathode of the light-emitting device. A control electrode of the second transistor is electrically connected to the second reset signal terminal, a first electrode of the second transistor is electrically connected to the second voltage terminal, and a second electrode of the second transistor is electrically connected to the driving sub-circuit.

In some embodiments, the driving sub-circuit includes a driving transistor and a storage capacitor. A control electrode of the driving transistor is electrically connected to a second end of the storage capacitor, a first electrode of the driving transistor is electrically connected to the writing sub-circuit and the light-emitting control sub-circuit, and a second electrode of the driving transistor is electrically connected to the light-emitting control sub-circuit and the compensation sub-circuit. A first end of the storage capacitor is electrically connected to a cathode of the light-emitting device.

In some embodiments, the writing sub-circuit includes a third transistor. A control electrode of the third transistor is electrically connected to the scanning signal terminal, a first electrode of the third transistor is electrically connected to the data signal terminal, and a second electrode of the third transistor is electrically connected to the driving sub-circuit.

In some embodiments, the compensation sub-circuit includes a fourth transistor. A control electrode of the fourth transistor is electrically connected to the scanning signal terminal, and a first electrode and a second electrode of the fourth transistor are electrically connected to the driving sub-circuit.

In some embodiments, the light-emitting control sub-circuit includes a fifth transistor and a sixth transistor. A control electrode of the fifth transistor is electrically connected to the light-emitting signal terminal, a first electrode of the fifth transistor is electrically connected to the driving sub-circuit, and a second electrode of the fifth transistor is electrically connected to the second voltage terminal. A control electrode of the sixth transistor is electrically connected to the light-emitting signal terminal, a first electrode of the sixth transistor is electrically connected to a cathode of the light-emitting device, and a second electrode of the sixth transistor is electrically connected to the driving sub-circuit.

In some embodiments, the initialization sub-circuit includes a first transistor and a second transistor, the writing sub-circuit includes a third transistor, the driving sub-circuit includes a driving transistor and a storage capacitor, the compensation sub-circuit includes a fourth transistor, and the light-emitting control sub-circuit includes a fifth transistor and a sixth transistor. A control electrode of the first transistor is electrically connected to the first reset signal terminal, a first electrode of the first transistor is electrically connected to the initialization voltage terminal, and a second electrode of the first transistor is electrically connected to a first end of the storage capacitor and a cathode of the light-emitting device. A control electrode of the second transistor is electrically connected to the second reset signal terminal, a first electrode of the second transistor is electrically connected to the second voltage terminal, and a second electrode of the second transistor is electrically connected to a second end of the storage capacitor. A control electrode of the third transistor is electrically connected to the scanning signal terminal, a first electrode of the third transistor is electrically connected to the data signal terminal, and a second electrode of the third transistor is electrically connected to a first electrode of the driving transistor. A control electrode of the driving transistor is electrically connected to the second end of the storage capacitor, the first electrode of the driving transistor is electrically connected to a second electrode of the sixth transistor, and a second electrode of the driving transistor is electrically connected to a first electrode of the fifth transistor. The first end of the storage capacitor is electrically connected to the cathode of the light-emitting device. A control electrode of the fourth transistor is electrically connected to the scanning signal terminal, a first electrode of the fourth transistor is electrically connected to the second electrode of the driving transistor, and a second electrode of the fourth transistor is electrically connected to the second end of the storage capacitor. A control electrode of the fifth transistor is electrically connected to the light-emitting signal terminal, and a second electrode of the fifth transistor is electrically connected to the second voltage terminal. A control electrode of the sixth transistor is electrically connected to the light-emitting signal terminal, and a first electrode of the sixth transistor is electrically connected to the cathode of the light-emitting device.

In some embodiments, the first to sixth transistors, and the driving transistor are P-type transistors.

In some embodiments, the driving sub-circuit is configured in such a way that a voltage of a second voltage signal received by the driving sub-circuit from the second voltage terminal is less than a voltage of a data signal received by the driving sub-circuit from the data signal terminal.

In another aspect, a display panel is provided. The display panel includes a plurality of sub-pixels, and at least one sub-pixel includes the above pixel circuit and a light-emitting device electrically connected to the pixel circuit.

In some embodiments, the light-emitting device is a self-luminous device.

In yet another aspect, a display apparatus is provided. The display apparatus includes the above display panel.

In yet another aspect, a method of driving a pixel circuit is provided. The method is applied to the above pixel circuit. In an image frame, the method of driving the pixel circuit includes: in a writing and compensation period: writing, by the writing sub-circuit, a data signal to the driving sub-circuit in response to a scanning signal, and compensating, by the compensation sub-circuit, the driving sub-circuit for a threshold voltage in response to the scanning signal; and in a light-emitting period: turning on, by the light-emitting control sub-circuit, a circuit between the first voltage terminal and the second voltage terminal in response to a light-emitting signal, and driving, by the driving sub-circuit, the light-emitting device to emit light according to a written data signal.

In some embodiments, the pixel circuit further includes an initialization sub-circuit, and before the scanning signal is received by the scanning signal terminal, the method of driving the pixel circuit further includes: in an initialization period: transmitting, by the initialization sub-circuit, an initialization voltage signal to the driving sub-circuit and the light-emitting device in response to a first reset signal, and transmitting, by the initialization sub-circuit, a second voltage signal to the driving sub-circuit in response to a second reset signal; and in the writing and compensation period: transmitting, by the initialization sub-circuit, the initialization voltage signal to the driving sub-circuit and the light-emitting device in response to the first reset signal.

In some embodiments, in the initialization period, the first reset signal and the second reset signal are low level signals, and the scanning signal and the light-emitting signal are high level signals. In the writing and compensation period, the first reset signal and the scanning signal are low level signals, and the data signal, the second reset signal, and the light-emitting signal are high level signals. In the light-emitting period, the light-emitting signal is a low level signal, and the first reset signal, the second reset signal, and the scanning signal are high level signals.

BRIEF DESCRIPTION OF THE DRAWINGS

In order to describe technical solutions in embodiments of the present disclosure more clearly, the accompanying drawings to be used in the description of embodiments will be introduced briefly. Obviously, the accompanying drawings to be described below are merely some embodiments of the present disclosure, and a person of ordinary skill in the art may obtain other drawings according to these drawings without paying any creative effort.

DETAILED DESCRIPTION

The technical solutions in embodiments of the present disclosure will be described clearly and completely with reference to the accompanying drawings in embodiments of the present disclosure. Obviously, the described embodiments are merely some but not all of embodiments of the present disclosure. All other embodiments made on the basis of the embodiments of the present disclosure by a person of ordinary skill in the art shall be included in the protection scope of the present disclosure.

In the related art, the display apparatus includes a plurality of sub-pixels, and each sub-pixel includes a pixel circuit. Due to the influence of the factors such as working time and manufacturing process, a threshold voltage Vth of the driving transistor in the pixel circuit may drift. That is, the threshold voltage Vth of the driving transistor may fluctuate. In addition, the drift amounts of the threshold voltages Vth of different driving transistors are different.

A driving current I for driving a light-emitting device in one sub-pixel is a product of K and a square of a difference of Vgs and Vth ($I=K(Vgs-Vth)^2$), wherein Vgs is a voltage difference between a control electrode and a source electrode of a driving transistor in a pixel circuit of this sub-pixel, and K is a factor related to the manufacturing process of the driving transistor. It can be seen from the formula that the driving current I is affected by the threshold voltage Vth. Therefore, the difference between drift amounts of the threshold voltages Vth of the driving transistors of the sub-pixels may cause the driving currents I flowing through the light-emitting devices of the sub-pixels to be inconsistent, that is, the luminance of the sub-pixels are inconsistent, thereby making the luminance of the display apparatus uneven.

Figure 1:
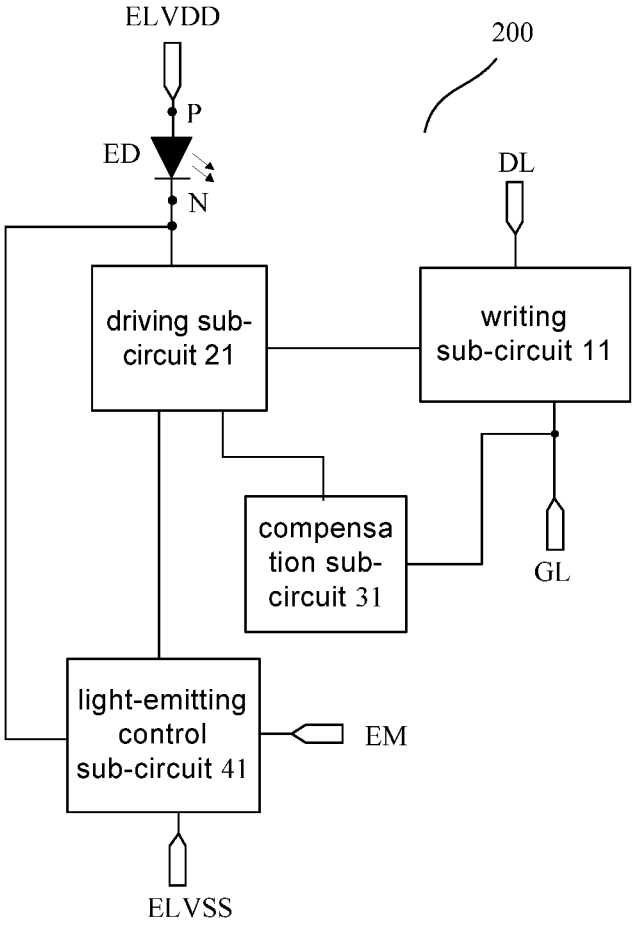
FIG. 1 is a schematic diagram showing a structure of a pixel circuit, in accordance with some embodiments.

Some embodiments of the present disclosure provide a pixel circuit 200, and as shown in FIG. 1, the pixel circuit 200 includes a writing sub-circuit 11, a driving sub-circuit 21, a compensation sub-circuit 31, and a light-emitting control sub-circuit 41.

The writing sub-circuit 11 is electrically connected to a data signal terminal DL, a scanning signal terminal GL, and the driving sub-circuit 21. The data signal terminal DL is configured to receive a data signal Vdata. The scanning signal terminal GL is configured to receive a scanning signal Gn. The writing sub-circuit 11 is configured to write the data signal Vdata to the driving sub-circuit 21 in response to the scanning signal Gn.

The compensation sub-circuit 31 is electrically connected to the scanning signal terminal GL and the driving sub-circuit 21. The compensation sub-circuit 31 is configured to compensate the driving sub-circuit 21 for a threshold voltage Vth in response to the scanning signal Gn.

The light-emitting control sub-circuit 41 is electrically connected to a light-emitting signal terminal EM and a second voltage terminal ELVSS, and is further electrically connected to a first voltage terminal ELVDD through a light-emitting device ED. For example, the light-emitting control sub-circuit 41 is electrically connected to a cathode N of the light-emitting device ED, and an anode P of the light-emitting device ED is electrically connected to the first voltage terminal ELVDD. The light-emitting signal terminal EM is configured to receive a light-emitting signal En. The second voltage terminal ELVSS is configured to receive a second voltage signal VSS. The first voltage terminal ELVDD is configured to receive a first voltage signal VDD. The light-emitting control sub-circuit 41 is configured to turn on a circuit between the first voltage terminal ELVDD and the second voltage terminal ELVSS in response to the light-emitting signal En.

The driving sub-circuit 21 is electrically connected to the light-emitting control sub-circuit 41 and the light-emitting device ED. The driving sub-circuit 21 is configured to drive the light-emitting device ED to emit light according to the written data signal Vdata.

In some embodiments, the light-emitting device ED is a self-luminous device, such as an electroluminescent (EL) device, a light-emitting diode (LED), an organic light-emitting diode (OLED), a micro light-emitting diode (Micro-LED), a mini light-emitting diode (Mini-LED) or a quantum dot light-emitting diode (QLED).

In some embodiments, the first voltage terminal ELVDD and the second voltage terminal ELVSS are configured to receive level signals with constant voltages. For example, the first voltage terminal ELVDD is configured to receive a high level signal with a constant voltage (i.e., the first voltage signal VDD is a high level signal with a constant voltage), and the second voltage terminal ELVSS is configured to receive a low level signal with a constant voltage (i.e., the second voltage signal VSS is a low level signal with a constant voltage).

In the above pixel circuit 200, the driving sub-circuit 21 is electrically connected to the light-emitting device ED, and the voltage of the level signal received by the first voltage terminal ELVDD electrically connected to the light-emitting device ED is a constant value. In addition, the data signal Vdata is written to the driving sub-circuit 21 by the writing sub-circuit 11, and then the driving sub-circuit 21 generates the driving current I for driving the light-emitting device ED to emit light. In this way, the voltage of the written data signal Vdata may affect the driving current I, so that the light-emitting device ED achieves different luminance, that is, the light-emitting devices ED display different gray scales.

The light-emitting control sub-circuit 41 turns on the circuit between the first voltage terminal ELVDD and the second voltage terminal ELVSS in response to the light-emitting signal En, so that the driving sub-circuit 21 is capable of generating the driving current I flowing through the light-emitting device ED, so as to drive the light-emitting device ED to emit light. On this basis, the driving sub-circuit 21 is compensated by the compensation sub-circuit 31 for the threshold voltage Vth, so that the driving current I generated by the driving sub-circuit 21 is independent of the threshold voltage Vth. As a result, the driving current I generated by the driving sub-circuit 21 will no longer be affected by the drift of the threshold voltage Vth, thus improving the uniformity of the driving currents I flowing through the light-emitting devices of the sub-pixels, thereby making the luminance of the display apparatus uniform, and improving its display effect.

Figure 2:
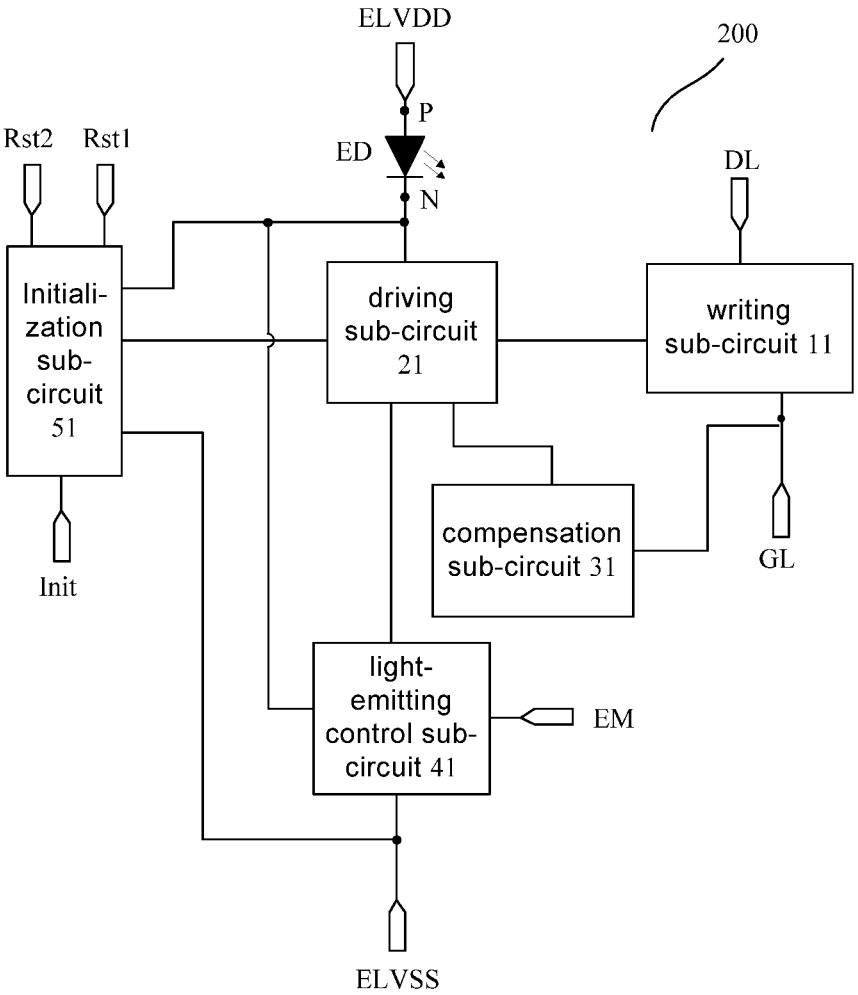
FIG. 2 is a schematic diagram showing a structure of another pixel circuit, in accordance with some embodiments.

In some embodiments, as shown in FIG. 2, the pixel circuit 200 further includes an initialization sub-circuit 51. The initialization sub-circuit 51 is electrically connected to a first reset signal terminal Rst1, a second reset signal terminal Rst2, an initialization voltage terminal Init, the second voltage terminal ELVSS, the driving sub-circuit 21, and the light-emitting device ED. The first reset signal terminal Rst1 is configured to receive a first reset signal $V_{R1}$. The second reset signal terminal Rst2 is configured to receive a second reset signal $V_{R2}$. The initialization voltage terminal Init is configured to receive an initialization voltage signal Vint.

The initialization sub-circuit 51 is configured to transmit the initialization voltage signal Vint to the driving sub-circuit 21 and the light-emitting device ED in response to the first reset signal $V_{R1}$.

In this way, the pixel circuit 200 may reset the light-emitting device ED through the initialization voltage signal Vint, so as to reduce the influence of the voltage of the previous image frame remaining in the light-emitting device ED on the light-emitting device ED, thereby reducing the probability of the occurrence of image sticking of the display apparatus, and improving display effect of the display apparatus.

For example, a voltage of the initialization voltage signal Vint is approximately equal to a voltage of the first voltage signal VDD. Here, since the voltage of the initialization voltage signal Vnit is very close to the voltage of the first voltage signal VDD, when the light-emitting device ED is reset through the initialization voltage signal Vint, the potentials at both ends of the light-emitting device ED are very close to each other, thereby reducing the number of carriers that are not recombined on the light-emitting interface inside the light-emitting device ED, and alleviating the aging of the light-emitting device ED.

For another example, the voltage of the initialization voltage signal Vint is equal to the voltage of the first voltage signal VDD. Thus, the potentials at both ends of the light-emitting device ED are equal, thereby further reducing the number of carriers that are not recombined on the light-emitting interface inside the light-emitting device ED or even eliminating these carriers, and further alleviating the aging of the light-emitting device ED.

In some embodiments, the initialization sub-circuit 51 is further configured to transmit the second voltage signal VSS to the driving sub-circuit 21 in response to the second reset signal $V_{R2}$.

In this way, the influence of the signal of the previous image frame remaining in the driving sub-circuit 21 on the signal written into the driving sub-circuit 20 in the present image frame may be reduced, thereby reducing its influence on the display image in the present image frame.

Hereinafter, referring to FIG. 3, the structure of each sub-circuit included in the above pixel circuit 200 will be exemplarily described.

Figure 3:
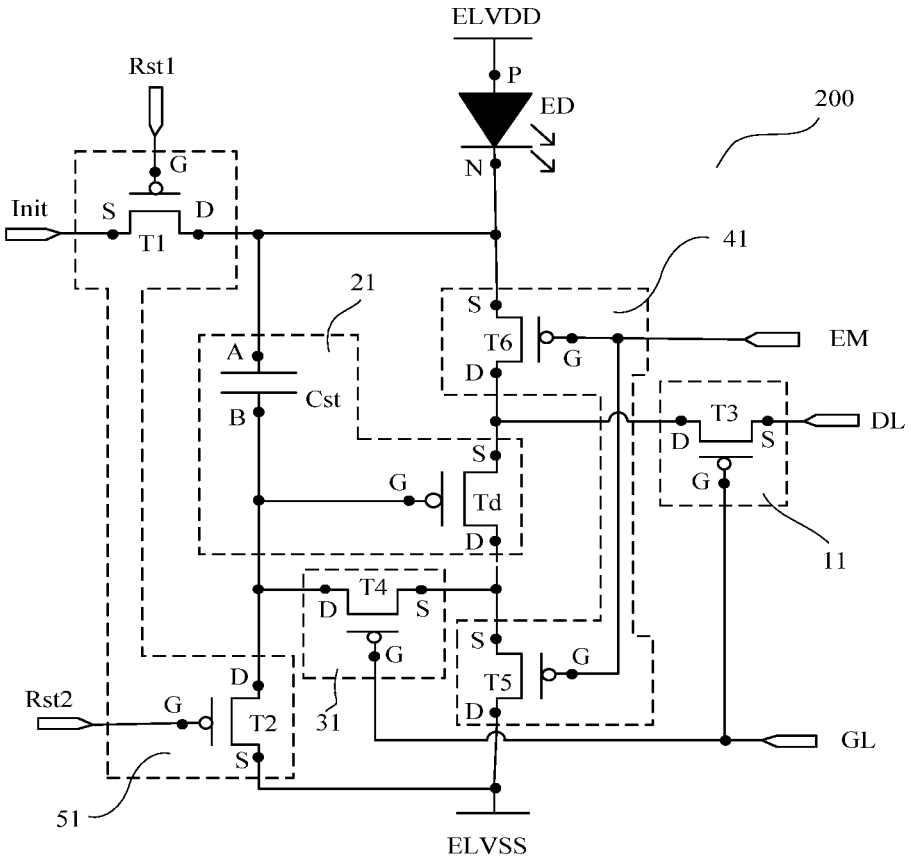
FIG. 3 is a schematic diagram showing a structure of yet another pixel circuit, in accordance with some embodiments.

In some embodiments, as shown in FIG. 3, the pixel circuit 200 includes the initialization sub-circuit 51, and the initialization sub-circuit 51 includes a first transistor T1 and a second transistor T2.

A control electrode G of the first transistor T1 is electrically connected to the first reset signal terminal Rst1, a first electrode S of the first transistor T1 is electrically connected to the initialization voltage terminal Init, and a second electrode D of the first transistor T1 is electrically connected to the driving sub-circuit 21 and the light-emitting device ED. The first transistor T1 is configured to be turned on under the control of the first reset signal $V_{R1}$, so as to transmit the initialization voltage signal Vint to the light-emitting device ED and the driving sub-circuit 21.

A control electrode G of the second transistor T2 is electrically connected to the second reset signal terminal Rst2, a first electrode S of the second transistor T2 is electrically connected to the second voltage terminal ELVSS, and a second electrode D of the second transistor T2 is electrically connected to the driving sub-circuit 21. The second transistor T2 is configured to be turned on under the control of the second reset signal $V_{R2}$, so as to transmit the second voltage signal VSS to the driving sub-circuit 21.

In some embodiments, as shown in FIG. 3, the driving sub-circuit 21 includes a driving transistor Td and a storage capacitor Cst.

A control electrode G of the driving transistor Td is electrically connected to a second end B of the storage capacitor Cst, a first electrode S of the driving transistor Td is electrically connected to the writing sub-circuit 11 and the light-emitting control sub-circuit 41, and a second electrode D of the driving transistor Td is electrically connected to the light-emitting control sub-circuit 41 and the compensation sub-circuit 31. The driving transistor Td is configured to be turned on under control of a voltage at a second end B of the storage capacitor Cst, so as to generate the driving current I in the circuit in which the light-emitting device ED is located.

A first end A of the storage capacitor Cst is electrically connected to the light-emitting device ED. The storage capacitor Cst is configured to store the voltage of the data signal Vdata.

In some embodiments, as shown in FIG. 3, the writing sub-circuit 11 includes a third transistor T3. A control electrode G of the third transistor T3 is electrically connected to the scanning signal terminal GL, a first electrode S of the third transistor T3 is electrically connected to the data signal terminal DL, and a second electrode D of the third transistor T3 is electrically connected to the driving sub-circuit 21. The third transistor T3 is configured to be turned on under the control of the scanning signal Gn, so as to transmit the data signal Vdata to the driving sub-circuit 21.

In some embodiments, as shown in FIG. 3, the compensation sub-circuit 31 includes a fourth transistor T4. A control electrode G of the fourth transistor T4 is electrically connected to the scanning signal terminal GL, and a first electrode S and a second electrode D of the fourth transistor T4 are electrically connected to the driving sub-circuit 21. The fourth transistor T4 is configured to be turned on under the control of the scanning signal Gn, so as to compensate the driving sub-circuit 21 for the threshold voltage Vth.

In some embodiments, as shown in FIG. 3, the light-emitting control sub-circuit 41 includes a fifth transistor T5 and a sixth transistor T6.

A control electrode G of the fifth transistor T5 is electrically connected to the light-emitting signal terminal EM, a first electrode S of the fifth transistor T5 is electrically connected to the driving sub-circuit 21, and a second electrode D of the fifth transistor T5 is electrically connected to the second voltage terminal ELVSS. A control electrode G of the sixth transistor T6 is electrically connected to the light-emitting signal terminal EM, a first electrode S of the sixth transistor T6 is electrically connected to the light-emitting device ED, and a second electrode D of the sixth transistor T6 is electrically connected to the driving sub-circuit 21.

Hereinafter the structure of the pixel circuit 200 will be exemplarily described.

In some embodiments, referring to FIG. 3, the initialization sub-circuit 51 includes a first transistor T1 and a second transistor T2, the writing sub-circuit 11 includes a third transistor T3, the driving sub-circuit 21 includes a driving transistor Td and a storage capacitor Cst, the compensation sub-circuit 31 includes a fourth transistor T4, and the light-emitting control sub-circuit 41 includes a fifth transistor T5 and a sixth transistor T6.

A control electrode G of the first transistor T1 is electrically connected to the first reset signal terminal Rst1, a first electrode S of the first transistor T1 is electrically connected to the initialization voltage terminal Init, and a second electrode D of the first transistor T1 is electrically connected to a first end A of the storage capacitor Cst and a cathode N of the light-emitting device ED.

A control electrode G of the second transistor T2 is electrically connected to the second reset signal terminal Rst2, a first electrode S of the second transistor T2 is electrically connected to the second voltage terminal ELVSS, and a second electrode D of the second transistor T2 is electrically connected to a second end B of the storage capacitor Cst.

A control electrode G of the third transistor T3 is electrically connected to the scanning signal terminal GL, a first electrode S of the third transistor T3 is electrically connected to the data signal terminal DL, and a second electrode D of the third transistor T3 is electrically connected to a first electrode S of the driving transistor Td.

A control electrode G of the driving transistor Td is electrically connected to the second end B of the storage capacitor Cst, the first electrode S of the driving transistor Td is electrically connected to a second electrode D of the sixth transistor T6, and a second electrode D of the driving transistor Td is electrically connected to a first electrode S of the fifth transistor T5.

The first end A of the storage capacitor Cst is electrically connected to the cathode N of the light-emitting device ED.

A control electrode G of the fourth transistor T4 is electrically connected to the scanning signal terminal GL, a first electrode S of the fourth transistor T4 is electrically connected to the second electrode D of the driving transistor Td, and a second electrode D of the fourth transistor T4 is electrically connected to the second end B of the storage capacitor Cst.

A control electrode G of the fifth transistor T5 is electrically connected to the light-emitting signal terminal EM, and a second electrode D of the fifth transistor T5 is electrically connected to the second voltage terminal ELVSS.

A control electrode G of the sixth transistor T6 is electrically connected to the light-emitting signal terminal EM, and a first electrode S of the sixth transistor T6 is electrically connected to the cathode N of the light-emitting device ED. The anode P of the light-emitting device ED is electrically connected to the first voltage terminal ELVDD.

In a case where the structure of the pixel circuit 200 is as described above, the first electrode S of the fourth transistor T4 is electrically connected to the second electrode D of the driving transistor Td, and the second electrode D of the fourth transistor T4 is electrically connected to the control electrode G of the driving transistor Td and the second end B of the storage capacitor Cst.

It will be noted that, in a case where a voltage at the second end B of the storage capacitor Cst is lower than the voltage of the data signal Vdata, a voltage Vs at the first electrode S of the driving transistor Td is greater than a voltage Vg at the control electrode G of the driving transistor Td, and thus the driving transistor Td is turned on.

On this basis, in a case where the driving transistor Td is turned on, and the fourth transistor T4 and the third transistor T3 are turned on under the control of the scanning signal Gn, the turned-on driving transistor Td is equivalent to a turned-on diode. In this case, if the voltage at the second end B of the storage capacitor Cst is lower than the voltage of the data signal Vdata, the data signal terminal DL is discharged towards the second end B of the storage capacitor Cst, and the potential at the second end B of the storage capacitor Cst increases gradually until the voltage difference Vsg between the first electrode S and the control electrode G of the driving transistor Td is decreased to the threshold voltage of the driving transistor Td. In this case, the driving transistor Td is turned off, and the data signal terminal DL stops being discharged towards the second end B of the storage capacitor Cst. When the driving transistor Td is turned off, the voltage at the second end B of the storage capacitor Cst is a difference of Vdata and Vth, and the voltage at the first end A of the storage capacitor Cst is equal to the voltage of the initialization voltage signal Vint. When the light-emitting device emits light, the voltage at the first electrode S of the driving transistor Td is Vint, the voltage at the control electrode G of the driving transistor Td is a difference of Vdata and Vth, and the voltage difference Vsg between the first electrode S and the control electrode G of the driving transistor Td is a sum of a difference of Vint and Vdata and Vth (Vsg=Vint−Vdata+Vth), thereby realizing compensation for the threshold voltage Vth of the driving transistor Td in the driving sub-circuit 21.

In addition, the second electrode D of the first transistor T1 is electrically connected to the first end A of the storage capacitor Cst, and the second electrode D of the second transistor T2 is electrically connected to the second end B of the storage capacitor Cst. Therefore, in a case where the first transistor T1 is turned on under the control of the first reset signal $V_{R1}$, and the second transistor T2 is turned on under the control of the second reset signal $V_{R2}$, the initialization voltage signal Vint is transmitted to the first end A of the storage capacitor Cst via the first transistor T1, and the second voltage signal VSS is transmitted to the second end B of the storage capacitor Cst via the second transistor T2, realizing the reset of the storage capacitor Cst, thereby reducing or even eliminating the influence of the data signal Vdata written into the storage capacitor Cst in the previous image frame on the image display in the present image frame.

Moreover, the second end B of the storage capacitor Cst is electrically connected to the control electrode G of the driving transistor Td, and thus the reset of the control electrode G of the driving transistor Td is also achieved in the above process.

Furthermore, the first end A and the second end B of the storage capacitor Cst are respectively controlled by different reset signals to be reset, and the cathode N of the light-emitting device ED electrically connected to the first end A of the storage capacitor Cst is controlled to be reset by using the first reset signal $V_{R1}$ alone, that is, the reset of the cathode N of the light-emitting device ED does not affect the voltage at the second end B of the storage capacitor Cst. In this way, while the data signal Vdata is written into the storage capacitor Cst, the first reset signal $V_{R1}$ may control the transmission of the initialization voltage signal Vint to the cathode N of the light-emitting device ED, so as to reset the light-emitting device ED, which increases the reset time of the light-emitting device ED, further reducing the number of carriers that are not recombined on the light-emitting interface inside the light-emitting device ED, and alleviating the aging of the light-emitting device ED.

In addition, the sub-pixels located in different regions of the display apparatus have different resistance drops (IR-drop) due to the different distances from the sub-pixels to the first voltage terminal ELVDD or to the second voltage terminal ELVSS. That is, voltages of first voltage signals VDD actually received by the sub-pixels located in different regions are different, or voltages of second voltage signals VSS actually received by the sub-pixels located in different regions are different. In the related art, the data signal Vdata written into the storage capacitor Cst will be affected by the first voltage signal VDD or the second voltage signal VSS, which causes the difference in the driving currents I for driving the light-emitting devices ED in the sub-pixels located in different regions, thereby aggravating uneven luminance of display apparatus.

In the pixel circuit 200 provided in the embodiments of the present disclosure, after the data signal Vdata is written, the voltage at the second end B of the storage capacitor Cst is a sum of Vdata and Vth, and the voltage at the first end A of the storage capacitor Cst is Vint. That is, the formula of the voltage difference between the first end A and the second end B of the storage capacitor Cst does not contain VDD or VSS. Therefore, the data signal Vdata written into the storage capacitor Cst is irrelevant to the first voltage signal VDD or the second voltage signal VSS, thereby improving the uniformity of the luminance of the display apparatus.

It will be noted that the function of the initialization voltage signal Vint is to reset the first end A of the storage capacitor Cst and the cathode N of the light-emitting device ED. When voltages at the first end A of the storage capacitor Cst and the cathode N of the light-emitting device ED are equal to Vint, there is almost no current flowing through the circuit between the initialization voltage terminal Init and the first end A of the storage capacitor Cst, and the circuit between the initialization voltage terminal Init and the cathode N of the light-emitting device ED. Therefore, even if distances from the sub-pixels located in different regions to the initialization voltage terminal Init are different, since there is almost no current flowing through the circuit between the initialization voltage terminal Init and the first end A of the storage capacitor Cst, and the circuit between the initialization voltage terminal Init and the cathode N of the light-emitting device ED, voltages of the initialization voltage signals Vint received by the sub-pixels located in different regions are almost equal. That is, the IR drop in the display apparatus is almost zero, thereby improving the uniformity of the luminance of the display apparatus.

In some embodiments, in a case where the structure of the pixel circuit 200 is as described above, the control electrodes G of the first to sixth transistors T1 to T6 and the driving transistor Td are gate electrodes, the first electrodes S thereof are source electrodes, and the second electrodes D thereof are drain electrodes.

In some embodiments, in a case where the structure of the pixel circuit 200 is as described above, the first to sixth transistors T1 to T6, and the driving transistor Td are P-type transistors. It will be noted that the P-type transistor is turned on in a case where the voltage difference Vsg between the first electrode S and the control electrode G of the P-type transistor is greater than or equal to the threshold voltage Vth of the P-type transistor.

In some embodiments, in a case where the structure of the pixel circuit 200 is as described above, the voltage of the second voltage signal VSS is less than the voltage of the data signal Vdata. After the second end B of the storage capacitor Cst is reset under the control of the second initialization signal $V_{R2}$, the voltage at the second end B of the storage capacitor Cst is equal to the voltage of the second voltage signal VSS. That is, in a case where the voltage of the data signal Vdata is greater than the voltage of the second voltage signal VSS, it can be ensured that the voltage at the second end B of the storage capacitor Cst is lower than the voltage of the data signal Vdata. That is, in a case where it can be ensured that the third transistor T3, the driving transistor Td, and the fourth transistor T4 are turned on, the data signal terminal DL are discharged towards the second end B of the storage capacitor Cst.

For example, the absolute value of the voltage of the second voltage signal VSS is less than a difference of the absolute value of the voltage of the data signal Vdata and the threshold voltage Vth. In this way, it is possible to ensure that the driving transistor Td is turned on during the writing of the data signal Vdata. When the voltage of the second end B of the storage capacitor Cst is increased to a difference of Vdata and Vth, the driving transistor Td is turned off, and the data signal terminal DL stops being discharged towards the second end B of the storage capacitor Cst, thereby ensuring compensation of the threshold voltage Vth.

Figure 9:
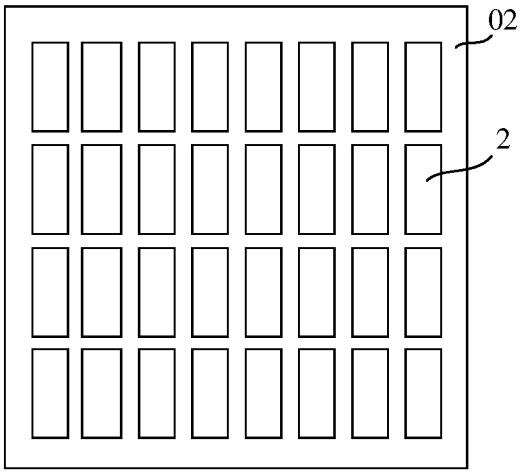
FIG. 9 is a schematic diagram showing a structure of a display panel, in accordance with some embodiments.

Some embodiments of the present disclosure provide a display panel 02, and as shown in FIG. 9, the display panel 02 includes a plurality of sub-pixels 2. The sub-pixel 2 includes a pixel circuit 200 as described above and the light-emitting device ED electrically connected to the pixel circuit 200. Since the pixel circuits 200 included in the display panel 02 have advantages of making the display apparatus have more uniform luminance, alleviating the aging of the light-emitting device ED, and the illumination of the sub-pixel not affected by the IR drop, the display panel 02 also has the advantages.

In some embodiments, the light-emitting device ED is a self-luminous device.

Some embodiments of the present disclosure provide a display apparatus, and the display apparatus includes the above display panel 02.

Illustratively, the display apparatus is any apparatus that displays an image regardless of motion (e.g., a video) or fixed images (e.g., still images) and whether text or picture. The described embodiments can be implemented in or associated with a variety of electronic devices such as, but not limited to, mobile phones, wireless devices, personal data assistants (PDA), handheld or portable computers, GPS receivers/navigators, cameras, MP4 video players, video cameras, game consoles, watches, clocks, calculators, TV monitors, flat panel displays, computer monitors, car monitors (for example, odometer displays, etc.), navigators, cockpit controllers and/or displays, camera view displays (e.g., displays of rear view cameras in vehicle), electronic photos, electronic billboards or signages, projectors, building structures, packaging and aesthetic structures (for example, displays for images of a piece of jewelry), etc.

Figure 4:
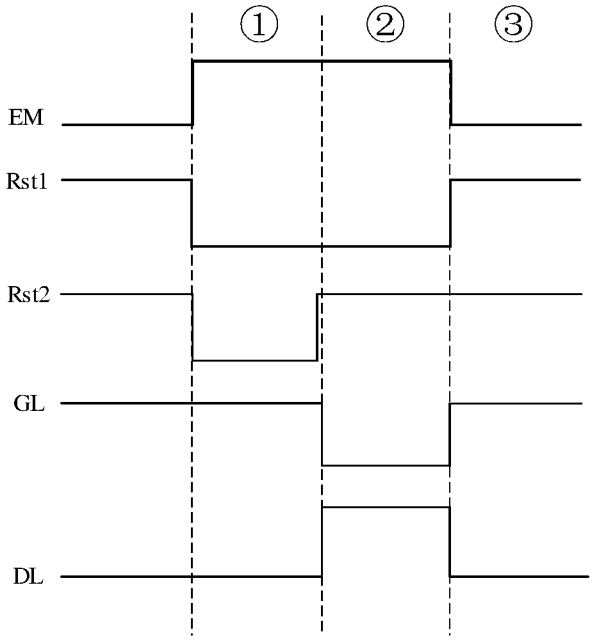
FIG. 4 is a signal timing diagram of a method of driving a pixel circuit, in accordance with some embodiments.
Figure 8:
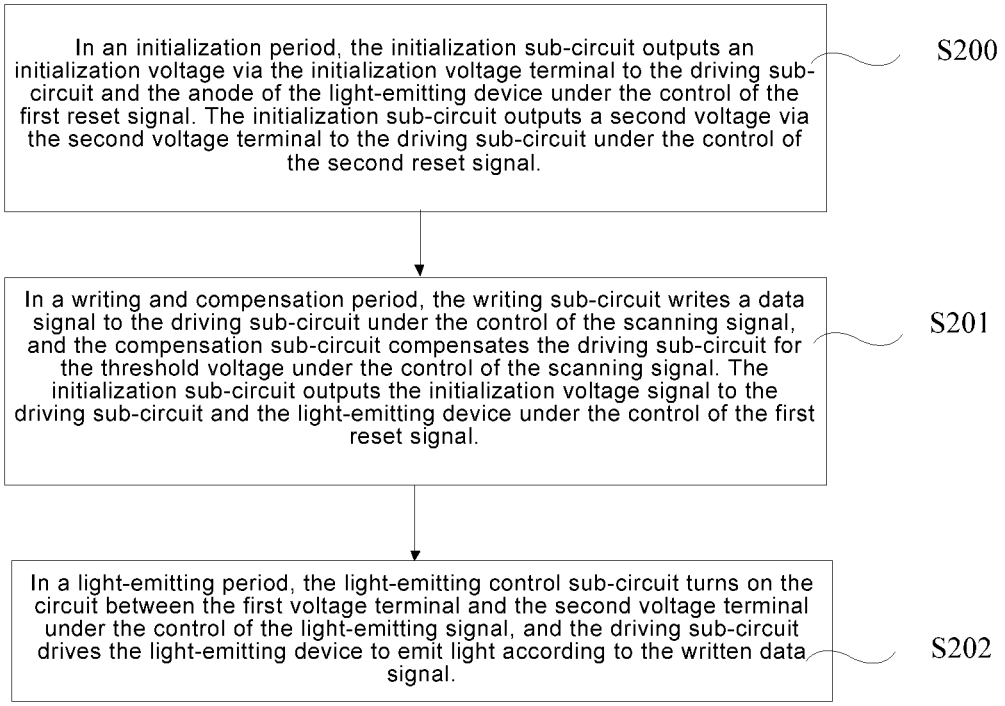
FIG. 8 is a flow diagram of a method of driving a pixel circuit, in accordance with some embodiments.

As shown in FIGS. 1, 4 and 8, some embodiments of the present disclosure further provide a method of driving a pixel circuit, which is applied to the pixel circuit 200 provided in any embodiment described above. In one image frame, the method of driving the pixel circuit includes S201 and S202.

In S201, in a writing and compensation period ②, the writing sub-circuit 11 writes a data signal Vdata to the driving sub-circuit 21 in response to a scanning signal Gn, and the compensation sub-circuit 31 compensates the driving sub-circuit 21 for the threshold voltage Vth in response to the scanning signal Gn.

In S202, in a light-emitting period ③, the light-emitting control sub-circuit 41 turns on a circuit between the first voltage terminal ELVDD and the second voltage terminal ELVSS in response to the light-emitting signal En, and the driving sub-circuit 21 drives the light-emitting device ED to emit light according to the written data signal Vdata.

The pixel circuit 200, to which the method of driving the pixel circuit is applied, has advantages of making the display apparatus have more uniform luminance, alleviating the aging of the light-emitting device ED, and the illumination of each sub-pixel not affected by the IR drop, and thus the method of driving the pixel circuit also has the advantages.

In some embodiments, as shown in FIGS. 2, 4, and 8, the pixel circuit 200 further includes an initialization sub-circuit 51. Before the scanning signal terminal GL receives the scanning signal Gn, the method of driving the pixel circuit further includes the following step.

S200, in an initialization period ①, the initialization sub-circuit 51 transmits the initialization voltage signal Vint to the driving sub-circuit 21 and the cathode N of the light-emitting device ED in response to the first reset signal $V_{R1}$, and the initialization sub-circuit 51 transmitting the second voltage signal VSS to the driving sub-circuit 21 in response to the second reset signal $V_{R2}$. In addition, in the writing and compensation period ②, the initialization sub-circuit 51 transmits an initialization voltage signal Vint to the driving sub-circuit 21 and the cathode N of the light-emitting device ED in response to the first reset signal $V_{R1}$.

In this way, in the method of driving the pixel circuit, the reset of the light-emitting device ED is continued from the beginning of the initialization period ① to the end of the writing and compensation period ②. The reset time is long, thereby reducing the number of carriers that are not recombined on the light-emitting interface inside the light-emitting device ED, and alleviating the aging of the light-emitting device ED.

Based on the above embodiments, in some embodiments, referring to FIG. 4, in the initialization period ①, the data signal Vdata, the first reset signal $V_{R1}$ and the second reset signal $V_{R2}$ are low level signals, and the scanning signal Gn and the light-emitting signal En are high level signals.

In the writing and compensation period ②, the first reset signal $V_{R1}$ and the scanning signal Gn are low level signals, and the data signal Vdata, the second reset signal $V_{R2}$, and the light-emitting signal En are high level signals.

In the light-emitting period ③, the light-emitting signal En and the data signal Vdata are low level signals, and the first reset signal $V_{R1}$, the second reset signal $V_{R2}$, and the scanning signal Gn are high level signals.

In some embodiments, in a case where the pixel circuit 200 has the structure shown in FIG. 3, referring to the signal timing diagram shown in FIG. 4, the transistors in the pixel circuit 200 are P-type transistors, The symbol "1" indicates that a high level signal is input, and the symbol "0" indicates that a low level signal is input. The method of driving the pixel circuit includes the following steps.

In the initialization period ① of an image frame: EM=1, Rst1=0, Rst2=0, and GL=1.

Figure 5:
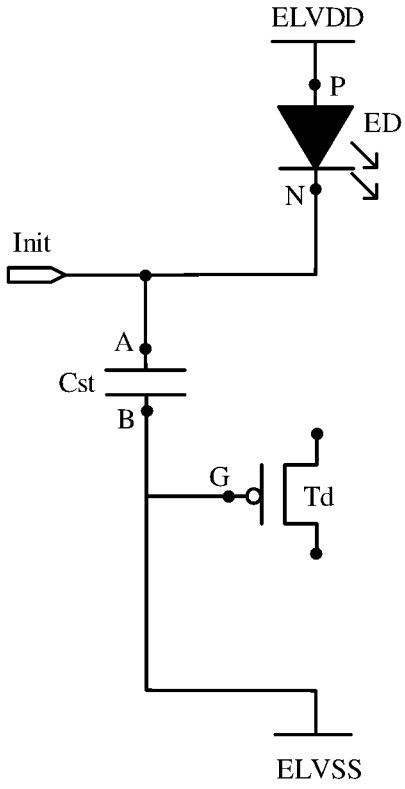
FIG. 5 is an equivalent circuit diagram of a pixel circuit in an initialization period, in accordance with some embodiments.

A low level signal is input via the first reset signal terminal Rst1, and the first transistor T1 is turned on. A low level signal is input via the second reset signal terminal Rst2, and the second transistor T2 is turned on. A high level signal is input via the scanning signal terminal GL, and the third transistor T3 and the fourth transistor T4 are turned off. A high level signal is input via the light-emitting signal terminal EM, and the fifth transistor T5 and the sixth transistor T6 are turned off. In this case, the equivalent circuit diagram of the pixel circuit 200 in the initialization period ① is as shown in FIG. 5.

The initialization voltage signal Vint received by the initialization voltage terminal Init is transmitted to the cathode N of the light-emitting device ED and the first end A of the storage capacitor Cst via the first transistor T1, thereby the cathode N of the light-emitting device ED is reset, so as to alleviate the aging of the light-emitting device ED. In addition, the voltage at the first end A of the storage capacitor Cst is reset to avoid the influence of the signal of the previous image frame remaining in the storage capacitor Cst on the display image in the present image frame.

Moreover, the second voltage signal VSS received by the second voltage terminal ELVSS is transmitted to the second end B of the storage capacitor Cst and the control electrode G of the driving transistor Td, so that the voltage Vg at the control electrode G of the driving transistor Td is equal to VSS (Vg=VSS). In this case, the voltage difference Vcst between the first end A and the second end B of the storage capacitor Cst is a difference of Vint and VSS (Vcst=Vint−VSS).

In the initialization period ①, since the fifth transistor T5 and the sixth transistor T6 are turned off, the circuit between the first voltage terminal ELVDD and the second voltage terminal ELVSS is in an off state, and the light-emitting device ED is in a non-illuminated state.

In the writing and compensation period ② of the image frame: EM=1, Rst1=0, Rst2=1, and GL=0.

Figure 6:
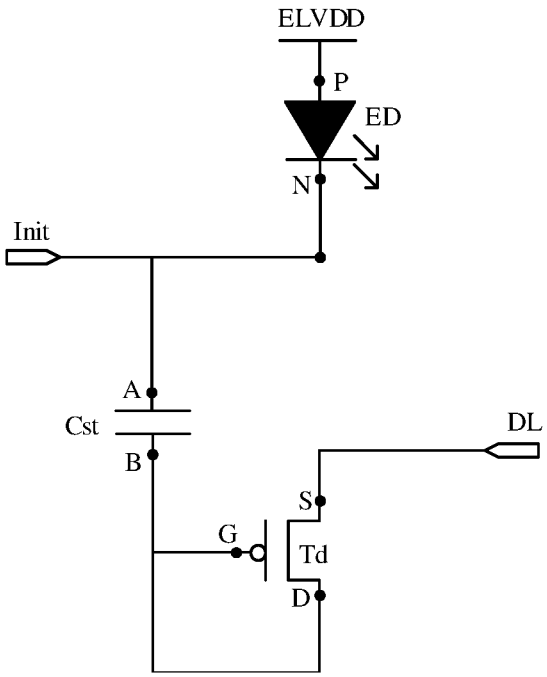
FIG. 6 is an equivalent circuit diagram of a pixel circuit in a writing and compensation period, in accordance with some embodiments.

A high level signal is input via the second reset signal terminal Rst2, and the second transistor T2 is turned off. A low level signal is input via the first reset signal terminal Rst1, and the first transistor T1 remains in an on state. A low level signal is input via the scanning signal terminal GL, and the third transistor T3 and the fourth transistor T4 are turned on. A high level signal is input via the light-emitting signal terminal EM, and the fifth transistor T5 and the sixth transistor T6 are turned off. In this case, the equivalent circuit diagram of the above pixel circuit 200 in the writing and compensation period ② is as shown in FIG. 6.

The fourth transistor T4 is turned on, and the second electrode D and the control electrode G of the driving transistor Td are electrically connected to each other. In this case, since the voltage at the control electrode G of the driving transistor Td is still the voltage in the previous period, which is equal to VSS, the driving transistor Td is equivalent to a turned-on diode. Further, since the third transistor T3 is turned on, the data signal Vdata from the data signal terminal DL is transmitted to the first electrode S of the driving transistor Td via the third transistor T3. The voltage of the data signal Vdata is high relative to the voltage at the second end B of the storage capacitor Cst. Therefore, the data signal terminal DL is discharged towards the second end B of the storage capacitor Cst through the turned-on driving transistor Td.

During the discharge of the data signal terminal DL towards the second end B of the storage capacitor Cst, the potential at the second end B of the storage capacitor Cst is continuously increased. That is, the voltage Vg at the control electrode G of the driving transistor Td electrically connected to the second end B of the storage capacitor Cst is continuously increased, so that the voltage difference Vsg between the voltage Vs at the first electrode S of the driving transistor Td and the voltage Vg at the control electrode G of the driving transistor Td is continuously decreased. When the voltage difference Vsg between the first electrode S and the control electrode G of the driving transistor Td is decreased to be equal to the threshold voltage Vth thereof, the driving transistor Td is turned off, and the data signal terminal DL stops being discharged towards the second end B of the storage capacitor Cst. In this case, the voltage at the control electrode G of the driving transistor Td is a difference of Vdata and Vth (Vg=Vdata−Vth).

In addition, the first transistor T1 is controlled to be in an on state through the first reset signal $V_{R1}$, and the potential at the first end A of the storage capacitor Cst is Vint.

In this case, the voltage difference Vcst between the first end A and the second end B of the storage capacitor Cst is a sum of a difference of Vint and Vdata and Vth (Vcst=Vint−Vdata+Vth).

Further, in the writing and compensation period ②, the first transistor T1 is controlled to be in an on state through the first reset signal $V_{R1}$. The initialization voltage signal Vint is intput via the initialization voltage terminal Init, and the cathode N of the light-emitting device ED is still be reset in the writing and compensating period ②, thereby extending the reset time of the cathode N of the light-emitting device ED, and further alleviating the aging of the light-emitting device ED.

In the light-emitting period ③ of the image frame, as shown in FIG. 4: EM=0, Rst1=1, Rst2=1, and GL=1.

Figure 7:
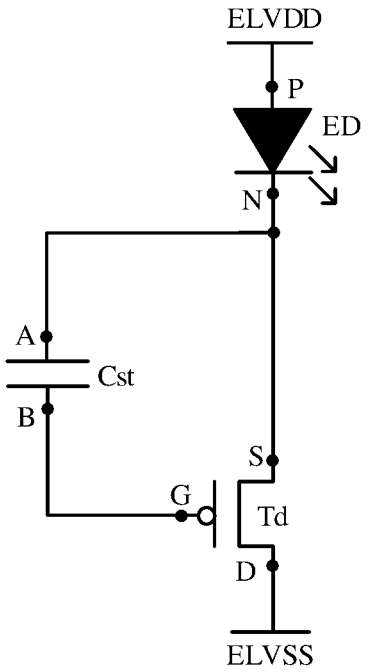
FIG. 7 is an equivalent circuit diagram of a pixel circuit in a light-emitting period, in accordance with some embodiments.

A high level signal is input via the first reset signal terminal Rst1, and the first transistor T1 is turned off. A high level signal is input via the second reset signal terminal Rst2, and the second transistor T2 is turned off. A high level signal is input via the scanning signal terminal GL, and the third transistor T3 and the fourth transistor T4 are turned off. A low level signal is input via the light-emitting signal terminal EM, and the fifth transistor T5 and the sixth transistor T6 are turned on. In this case, the equivalent circuit diagram of the above pixel circuit 200 in the light-emitting period ③ is as shown in FIG. 7.

The second end B of the storage capacitor Cst is electrically connected to the control electrode G of the driving transistor Td, and the first end A of the storage capacitor Cst is electrically connected to the first electrode S of the driving transistor Td. In this case, the voltage difference Vsg between the first electrode S and the control electrode G of the driving transistor Td is equal to the voltage difference Vcst between the first end A and the second end B of the storage capacitor Cst. That is, both Vsg and Vcst are equal to a sum of a difference between Vint and Vdata and Vth (Vsg=Vcst=Vint−Vdata+Vth).

In addition, the first voltage signal VDD is able to ensure that the voltage difference Vsd between the first electrode S and the second electrode D of the driving transistor Td is greater than a difference between Vsg and Vth (Vsd>Vsg−Vth), and thus the driving transistor Td is in a saturated state.

In this way, the circuit between the first voltage terminal ELVDD and the second voltage terminal ELVSS is turned on, and the formula of the driving current I for driving the light-emitting device ED to emit light is:

$$I=K(Vsg-Vth)^2=K(V\text{int}-V\text{data}+Vth-Vth)^2=K(V\text{int}-V\text{data})^2. \quad (2)$$

Wherein K is a factor related to the manufacturing process of the driving transistor Td.

As can be seen from the above formula (2), the driving current I for driving the light-emitting device ED to emit light is independent of the threshold voltage Vth of the driving transistor Td, and thus the driving current I is not affected by the drift of the threshold voltage Vth of the driving transistor Td. Therefore, the uniformity of the driving currents I of the light-emitting devices ED flowing through the respective sub-pixels is improved, thereby making the luminance of the display apparatus more uniform and improving the display effect thereof.

In addition, the sub-pixels located in different regions in the display apparatus have resistance drops even if the distances from the sub-pixels to the first voltage terminal ELVDD or the second voltage terminal ELVSS are different, but since the driving current I for driving the light-emitting device ED to emit light is independent of the first voltage signal VDD and the second voltage signal VSS, the above resistance drops do not affect the driving currents I in the sub-pixels, thereby improving the uniformity of the luminance of the display apparatus.

As can be seen from the above formula (2), in a case where the voltage of the initialization voltage signal Vint is constant, the driving current I is related to the data signal Vdata written to the driving transistor Td. Therefore, in some embodiments, by adjusting the data signals Vdata from the data signal terminal DL, the display apparatus may display an image with different gray scales.

A person of ordinary skill in the art can understand that: a related hardware may be controlled by a program to implement all or part of the steps in the method embodiments described above. The program may be stored in a computer-readable storage medium. When the program is executed by the hardware (for example, a processor), the steps included in the method embodiments above are performed. The storage medium includes various media that can store program codes, such as a read-only memory (ROM), a random-access memory (RAM), a magnetic disk, or an optical disk.

Figure 10:
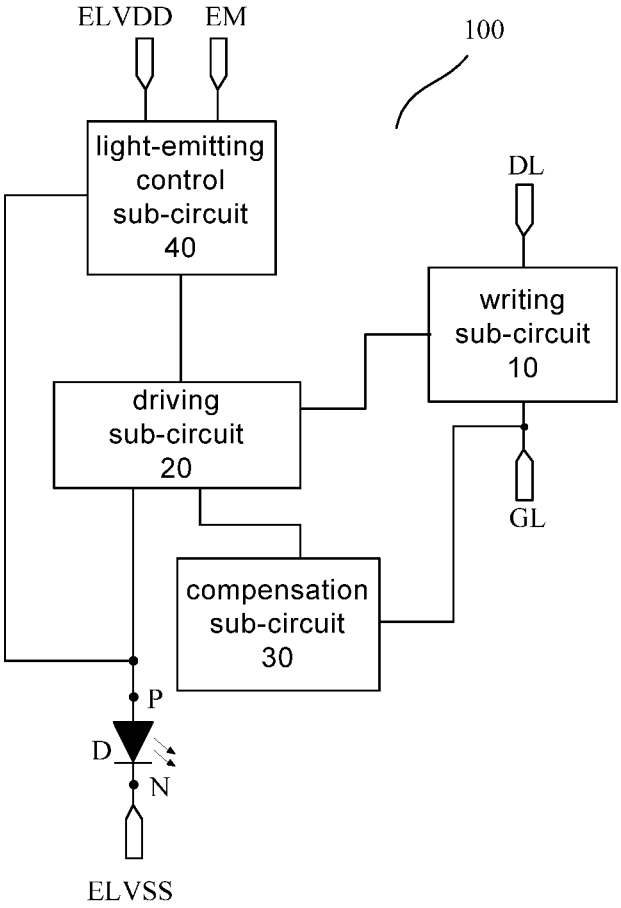
FIG. 10 is a schematic diagram showing a structure of yet another pixel circuit, in accordance with some embodiments.

Some embodiments of the present disclosure provide another pixel circuit 100, and as shown in FIG. 10, the pixel circuit 100 includes a writing sub-circuit 10, a driving sub-circuit 20, a compensation sub-circuit 30, and a light-emitting control sub-circuit 40.

The writing sub-circuit 10 is electrically connected to a data signal terminal DL, a scanning signal terminal GL, and the driving sub-circuit 20. The data signal terminal DL is configured to receive a data signal Vdata. The scanning signal terminal GL is configured to receive a scanning signal Gn. The writing sub-circuit 10 is configured to write the data signal Vdata to the driving sub-circuit 20 under the control of the scanning signal Gn.

The compensation sub-circuit 30 is electrically connected to the scanning signal terminal GL and the driving sub-circuit 20, and is configured to compensate the driving sub-circuit 20 for the threshold voltage Vth under the control of the scanning signal Gn.

The light-emitting control sub-circuit 40 is electrically connected to a light-emitting signal terminal EM and a first voltage terminal ELVDD, and is further electrically connected to a second voltage terminal ELVSS through a light-emitting device ED. For example, the light-emitting control sub-circuit 40 is electrically connected to an anode P of the light-emitting device ED, and a cathode N of the light-emitting device ED is electrically connected to the second voltage terminal ELVSS. The light-emitting signal terminal EM is configured to receive a light-emitting signal En. The first voltage terminal ELVDD is configured to receive a first voltage signal VDD. The second voltage terminal ELVSS is configured to receive a second voltage signal VSS. The light-emitting control sub-circuit 40 is configured to turn on a circuit between the first voltage terminal ELVDD and the second voltage terminal ELVSS under the control of the light-emitting signal En.

The driving sub-circuit 20 is electrically connected to the light-emitting control sub-circuit 40 and the light-emitting device ED, and is configured to drive the light-emitting device ED to emit light according to the written data signal Vdata.

In some embodiments, the light-emitting device ED is a self-luminous device, such as an electroluminescent (EL)

device, a light-emitting diode (LED), an organic light-emitting diode (OLED), a micro light-emitting diode (Micro-LED), a mini light-emitting diode (Mini-LED) or a quantum dot light-emitting diode (QLED).

In some embodiments, the first voltage terminal ELVDD and the second voltage terminal ELVSS are configured to receive signals with constant voltages, respectively. For example, the first voltage terminal ELVDD is configured to receive a high level signal with a constant voltage, and the second voltage terminal ELVSS is configured to receive a low level signal with a constant voltage. For another example, the first voltage terminal ELVDD is configured to receive a low level signal with a constant voltage, and the second voltage terminal ELVSS is configured to receive a high level signal with a constant voltage.

In the pixel circuit 100 provided in the above embodiments, the driving sub-circuit 20 is electrically connected to the light-emitting device ED, and the voltage at the second voltage terminal ELVSS electrically connected to the light-emitting device ED is a constant value. In addition, the data signal Vdata is written to the driving sub-circuit 20 by the writing sub-circuit 10, and then the driving sub-circuit 20 generates the driving current I for driving the light-emitting device ED to emit light. In this way, the voltage of the written data signal Vdata may affect the driving current I, so that the light-emitting device ED achieves different luminance, that is, the light-emitting devices ED display different gray scales.

The light-emitting control sub-circuit 40 turns on the circuit between the first voltage terminal ELVDD and the second voltage terminal ELVSS under the control of the light-emitting signal En, so that the driving current I generated by the driving sub-circuit 20 may be transmitted to the light-emitting device ED through the turned-on circuit, so as to drive the light-emitting device ED to emit light. On this basis, the driving sub-circuit 20 is compensated by the compensation sub-circuit 30 for the threshold voltage Vth, so that the driving current I generated by the driving sub-circuit 20 is independent of the threshold voltage Vth. As a result, the driving current I generated by the driving sub-circuit 20 will no longer be affected by the drift of the threshold voltage Vth, thus improving the uniformity of the driving currents I flowing through the light-emitting devices ED of the sub-pixels, thereby making the luminance of the display apparatus more uniform, and improving its display effect.

Figure 11:
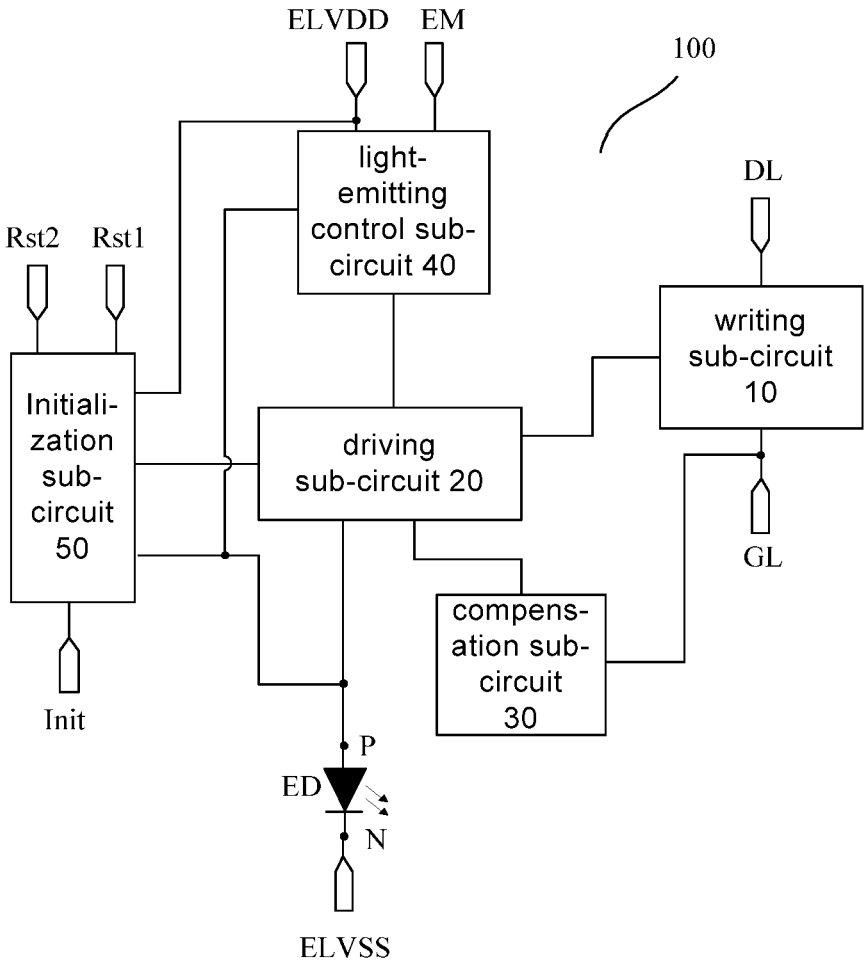
FIG. 11 is a schematic diagram showing a structure of yet another pixel circuit, in accordance with some embodiments.

In some embodiments, as shown in FIG. 11, the pixel circuit 100 further includes an initialization sub-circuit 50. The initialization sub-circuit 50 is electrically connected to a first reset signal terminal Rst1, a second reset signal terminal Rst2, an initialization voltage terminal Init, the first voltage terminal ELVDD, the driving sub-circuit 20, and the light-emitting device ED. The first reset signal terminal Rst1 is configured to receive a first reset signal $V_{R1}$. The second reset signal terminal Rst2 is configured to receive a second reset signal $V_{R2}$. The initialization voltage terminal Init is configured to receive an initialization voltage signal Vint.

The initialization sub-circuit 50 is configured to transmit the initialization voltage signal Vint to the driving sub-circuit 20 and the light-emitting device ED under control of the first reset signal $V_{R1}$.

In this way, the pixel circuit 100 may reset the light-emitting device ED by using the initialization voltage signal Vint, so as to reduce the influence of the voltage of the previous image frame remaining in the light-emitting device ED on the light-emitting device ED, thereby reducing the probability of the occurrence of image sticking of the display apparatus, and improving the display effect of the display apparatus.

For example, a voltage of the initialization voltage signal Vint is approximately equal to a voltage of the second voltage signal VSS. Since the voltage of the initialization voltage signal Vnit is very close to the voltage of the second voltage signal VSS, when the light-emitting device ED is reset by using the initialization voltage signal Vint, the potentials at both ends of the light-emitting device ED are very close to each other, thereby reducing the number of carriers that are not recombined on the light-emitting interface inside the light-emitting device ED, and alleviating the aging of the light-emitting diode ED.

For another example, the voltage of the initialization voltage signal Vint is equal to the voltage of the second voltage signal VSS. Thus, the potentials at both ends of the light-emitting device ED are equal, thereby further reducing the number of carriers that are not recombined on the light-emitting interface inside the light-emitting device ED or even eliminating these carriers, and further alleviating the aging of the light-emitting diode.

In some embodiments, the initialization voltage signal Vint is a grounded signal. In this case, the initialization voltage signal Vint has a potential close to or even equal to the zero potential.

In some embodiments, the initialization sub-circuit 50 is further configured to transmit the first voltage signal VDD to the driving sub-circuit 20 under the control of the second reset signal $V_{R2}$.

In this way, the influence of the signal of the previous image frame remaining in the driving sub-circuit 20 on the signal written into the driving sub-circuit 20 in the present image frame may be reduced, thereby reducing its influence on the display image in the present image frame.

Hereinafter the structure of each sub-circuit included in the above pixel circuit 100 will be exemplarily described.

Figure 12:
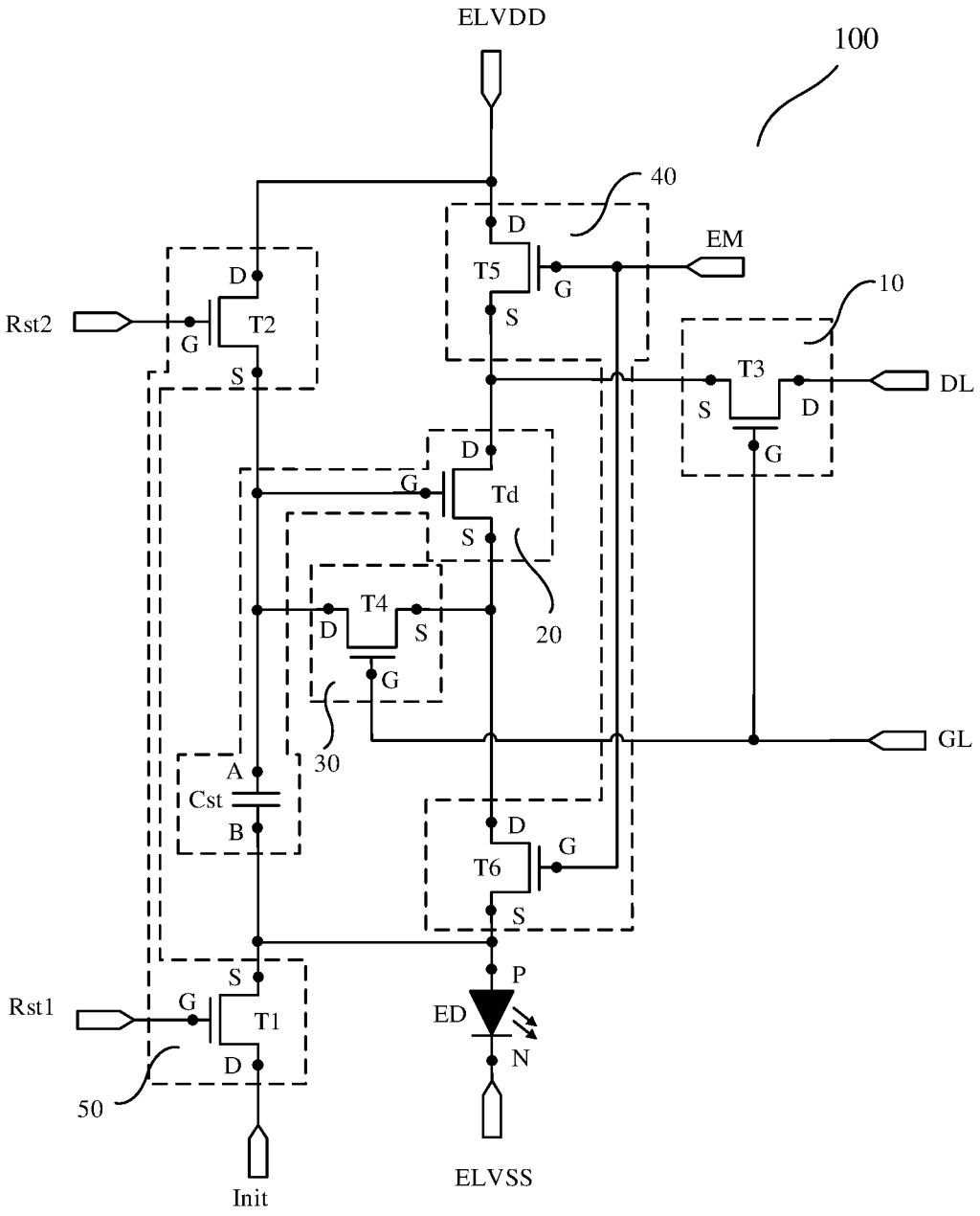
FIG. 12 is a schematic diagram showing a structure of yet another pixel circuit, in accordance with some embodiments.

In some embodiments, the pixel circuit 100 includes an initialization sub-circuit 50, and as shown in FIG. 12, the initialization sub-circuit 50 includes a first transistor T1 and a second transistor T2. A control electrode G of the first transistor T1 is electrically connected to the first reset signal terminal Rst1, a first electrode D of the first transistor T1 is electrically connected to the initialization voltage terminal Init, and a second electrode S of the first transistor T1 is electrically connected to the driving sub-circuit 20 and an anode P of the light-emitting device ED. A control electrode G of the second transistor T2 is electrically connected to the second reset signal terminal Rst2, a first electrode D of the second transistor T2 is electrically connected to the first voltage terminal ELVDD, and a second electrode S of the second transistor T2 is electrically connected to the driving sub-circuit 20.

In some embodiments, as shown in FIG. 12, the driving sub-circuit 20 includes a driving transistor Td and a storage capacitor Cst. A control electrode G of the driving transistor Td is electrically connected to a first end A of the storage capacitor Cst, a first electrode D of the driving transistor Td is electrically connected to the writing sub-circuit 10 and the light-emitting control sub-circuit 40, and a second electrode S of the driving transistor Td is electrically connected to the light-emitting control sub-circuit 40 and the compensation sub-circuit 30. A second end B of the storage capacitor Cst is electrically connected to the anode P of the light-emitting device ED.

In some embodiments, as shown in FIG. 12, the writing sub-circuit 10 includes a third transistor T3. A control electrode G of the third transistor T3 is electrically connected to the scanning signal terminal GL, a first electrode D of the third transistor T3 is electrically connected to the data signal terminal DL, and a second electrode S of the third transistor T3 is electrically connected to the driving sub-circuit 20.

In some embodiments, as shown in FIG. 12, the compensation sub-circuit 30 includes a fourth transistor T4. A control electrode G of the fourth transistor T4 is electrically connected to the scanning signal terminal GL, and a first electrode D and a second electrode S of the fourth transistor T4 are electrically connected to the driving sub-circuit 20.

In some embodiments, as shown in FIG. 12, the light-emitting control sub-circuit 40 includes a fifth transistor T5 and a sixth transistor T6. A control electrode G of the fifth transistor T5 is electrically connected to the light-emitting signal terminal EM, a first electrode D of the fifth transistor T5 is electrically connected to the first voltage terminal ELVDD, and a second electrode S of the fifth transistor T5 is electrically connected to the driving sub-circuit 20. A control electrode G of the sixth transistor T6 is electrically connected to the light-emitting signal terminal EM, a first electrode D of the sixth transistor T6 is electrically connected to the driving sub-circuit 20, and a second electrode S of the sixth transistor T6 is electrically connected to the anode P of the light-emitting device ED.

Hereinafter the specific structure of the pixel circuit 100 in some embodiments of the present disclosure will be exemplarily described.

In some embodiments, referring to FIG. 12, the initialization sub-circuit 50 includes a first transistor T1 and a second transistor T2, the writing sub-circuit 10 includes a third transistor T3, the driving sub-circuit 20 includes a driving transistor Td and a storage capacitor Cst, the compensation sub-circuit 30 includes a fourth transistor T4, and the light-emitting control sub-circuit 40 includes a fifth transistor T5 and a sixth transistor T6.

A control electrode G of the first transistor T1 is electrically connected to the first reset signal terminal Rst1, a first electrode D of the first transistor T1 is electrically connected to the initialization voltage terminal Init, and a second electrode S of the first transistor T1 is electrically connected to a second end B of the storage capacitor Cst and the anode P of the light-emitting device ED.

A control electrode G of the second transistor T2 is electrically connected to the second reset signal terminal Rst2, a first electrode D of the second transistor T2 is electrically connected to the first voltage terminal ELVDD, and a second electrode S of the second transistor T2 is electrically connected to a first end A of the storage capacitor Cst.

A control electrode G of the third transistor T3 is electrically connected to the scanning signal terminal GL, a first electrode D of the third transistor T3 is electrically connected to the data signal terminal DL, and a second electrode S of the third transistor T3 is electrically connected to the first electrode D of the driving transistor Td.

A control electrode G of the driving transistor Td is electrically connected to the first end A of the storage capacitor Cst, the first electrode D of the driving transistor Td is electrically connected to a second electrode S of the fifth transistor T5, and a second electrode S of the driving transistor Td is electrically connected to a first electrode D of the sixth transistor T6.

The second end B of the storage capacitor Cst is electrically connected to the anode P of the light-emitting device ED.

A control electrode G of the fourth transistor T4 is electrically connected to the scanning signal terminal GL, a first electrode D of the fourth transistor T4 is electrically connected to the first end A of the storage capacitor Cst, and a second electrode S of the fourth transistor T4 is electrically connected to the second electrode S of the driving transistor Td.

A control electrode G of the fifth transistor T5 is electrically connected to the light-emitting signal terminal EM, and a first electrode D of the fifth transistor T5 is electrically connected to the first voltage terminal ELVDD.

A control electrode G of the sixth transistor T6 is electrically connected to the light-emitting signal terminal EM, and a second electrode S of the sixth transistor T6 is electrically connected to the anode P of the light-emitting device ED. The cathode N of the light-emitting device ED is electrically connected to the second voltage terminal ELVSS.

In a case where the structure of the pixel circuit 100 is as described above, the first electrode D of the fourth transistor T4 is electrically connected to the control electrode G of the driving transistor Td and the first end A of the storage capacitor Cst, and the second electrode S of the fourth transistor T4 is electrically connected to the second electrode S of the driving transistor Td.

On this basis, in a case where the driving transistor Td is turned on, and the fourth transistor T4 and the third transistor T3 are turned on under the control of the scanning signal Gn, the turned-on driving transistor Td is equivalent to a turned-on diode. In this case, if the potential at the first end A of the storage capacitor Cst is higher than the potential at the data signal terminal DL, the first end A of the storage capacitor Cst is discharged towards the data signal terminal DL until the voltage difference Vgs between the control electrode G and the first electrode D of the driving transistor Td is decreased to the threshold voltage of the driving transistor Td. In this case, the driving transistor Td is turned off, and the storage capacitor Cst stops being discharged towards the data signal terminal DL. When the driving transistor Td is turned off, the voltage at the first end A of the storage capacitor Cst is a sum of Vdata and Vth, thereby compensating the storage capacitor Cst in the driving sub-circuit 20 for the threshold voltage Vth of the driving transistor Td.

In addition, the second electrode S of the first transistor T1 is electrically connected to the second end B of the storage capacitor Cst, and the second electrode S of the second transistor T2 is electrically connected to the control electrode G of the driving transistor Td. Therefore, in a case where the first transistor T1 is turned on under the control of the first reset signal $V_{R1}$, and the second transistor T2 is turned on under the control of the second reset signal $V_{R2}$, the initialization voltage signal Vint is transmitted to the second end B of the storage capacitor Cst via the first transistor T1, and the first voltage signal VDD is transmitted to the first end A of the storage capacitor Cst via the second transistor T2, realizing the reset of the storage capacitor Cst, thereby reducing or even eliminating the influence of the data signal Vdata written into the storage capacitor Cst in the previous image frame on the image display in the present image frame.

Moreover, the first end A of the storage capacitor Cst is electrically connected to the control electrode G of the driving transistor Td, and thus the reset of the control electrode G of the driving transistor Td is also achieved in the above process.

Furthermore, the first end A and the second end B of the storage capacitor Cst are respectively controlled to be reset by different reset signals, and the anode P of the light-emitting device ED electrically connected to the first end A of the storage capacitor Cst is controlled to be reset by the first reset signal $V_{R1}$ alone. In this way, when the data signal Vdata is written into the storage capacitor Cst, the first reset signal $V_{R1}$ may control the output of the initialization voltage signal Vint to the anode P of the light-emitting device ED, so as to reset the light-emitting device ED, which increases the reset time of the light-emitting device ED, further reducing the number of carriers that are not recombined on the light-emitting interface inside the light-emitting device ED, and alleviating the aging thereof.

In addition, the sub-pixels located in different regions in the display apparatus have different voltage drops (IR-drop) due to the different distances from the sub-pixels to the first voltage terminal ELVDD or to the second voltage terminal ELVSS. That is, voltages of first voltage signals VDD actually received by the sub-pixels located in different regions are different, or voltages of second voltage signal VSS actually received by the sub-pixels located in different regions are different. In the related art, the data signal Vdata written into the storage capacitor Cst will be effected by the first voltage signal VDD or the second voltage signal VSS, which causes the difference in the driving currents I for driving the light-emitting devices ED in the sub-pixels located in different regions, thereby aggravating uneven luminance of display apparatus.

In the pixel circuit 100 provided in the embodiments of the present disclosure, after the data signal Vdata is written, the voltage at the first end A of the storage capacitor Cst is a sum of Vdata and Vth, and the voltage at the second end B of the storage capacitor Cst is Vint. Therefore, the data signal Vdata written into the storage capacitor Cst is irrelevant to the first voltage signal VDD or the second voltage signal VSS, thereby improving the uniformity of the luminance of display apparatus.

In some embodiments, in a case where the structure of the pixel circuit 100 is as described above, the control electrodes G of the first to sixth transistors T1 to T6 and the driving transistor Td are gate electrodes, the first electrodes D thereof are source electrodes, and the second electrodes S thereof are drain electrodes. In some other embodiments, the control electrodes G of the first to sixth transistors T1 to T6 and the driving transistor Td are gate electrodes, the first electrodes D thereof are drain electrodes, and the second electrodes S thereof are source electrodes.

In some embodiments, in a case where the structure of the pixel circuit 100 is as described above, the first to sixth transistors T1 to T6, and the driving transistor Td are N-type transistors. Here, in a case where the voltage difference Vgs between the control electrode G and the second electrode S of the N-type transistor is greater than or equal to the threshold voltage Vth, the N-type transistor is turned on.

In some embodiments, in a case where the structure of the pixel circuit 100 is as described above, the absolute value of the voltage of the first voltage signal VDD is greater than the absolute value of the voltage of the data signal Vdata. In this way, it may be ensured that the first end A of the storage capacitor Cst is discharged towards the data signal terminal DL in the case where the third transistor T3, the driving transistor Td and the fourth transistor T4 are turned on.

In some other embodiments, the absolute value of the voltage of the first voltage signal VDD is greater than or equal to the sum of the absolute value of the voltage of the data signal Vdata and the threshold voltage Vth. In this way, when the voltage at the first end A of the storage capacitor Cst is lowered to a sum of Vdata and Vth, the driving transistor Td is turned off, and the storage capacitor Cst stops being discharged to the data signal terminal DL, thereby ensuring compensation of the threshold voltage Vth.

Figure 18:
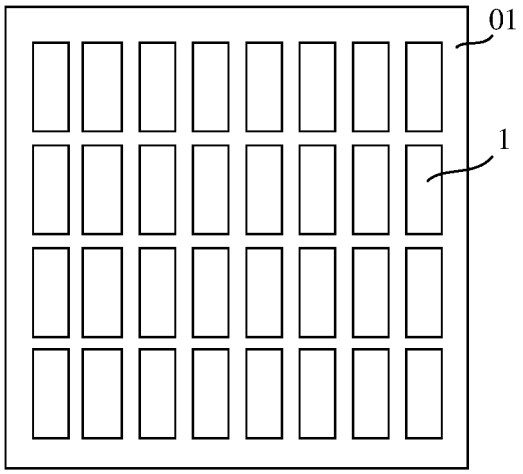
FIG. 18 is a schematic diagram showing a structure of another display panel, in accordance with some embodiments.

Some embodiments of the present disclosure provide a display panel 01, and as shown in FIG. 18, the display panel 01 includes a plurality of sub-pixels 1. The sub-pixel 1 includes a pixel circuit 100 as described above and the light-emitting device ED electrically connected to the pixel circuit 100. Since the pixel circuit 100 included in the display panel 01 has advantages of making the display apparatus have more uniform luminance, alleviating the aging of the light-emitting device ED, and the illumination of each sub-pixel 1 not affected by the IR drop, the display panel 01 also has the advantages.

In some embodiments, the light-emitting device is a self-luminous device.

Some embodiments of the present disclosure provide a display apparatus, which includes the above display panel 01.

Illustratively, the display apparatus is any apparatus that displays an image regardless of motion (e.g., a video) or fixed images (e.g., still images) and whether text or picture. The described embodiments can be implemented in or associated with a variety of electronic devices such as, but not limited to, mobile phones, wireless devices, personal data assistants (PDA), handheld or portable computers, GPS receivers/navigators, cameras, MP4 video players, video cameras, game consoles, watches, clocks, calculators, TV monitors, flat panel displays, computer monitors, car monitors (for example, odometer displays, etc.), navigators, cockpit controllers and/or displays, camera view displays (e.g., displays of rear view cameras in vehicle), electronic photos, electronic billboards or signages, projectors, building structures, packaging and aesthetic structures (for example, displays for images of a piece of jewelry), etc.

Figure 13:
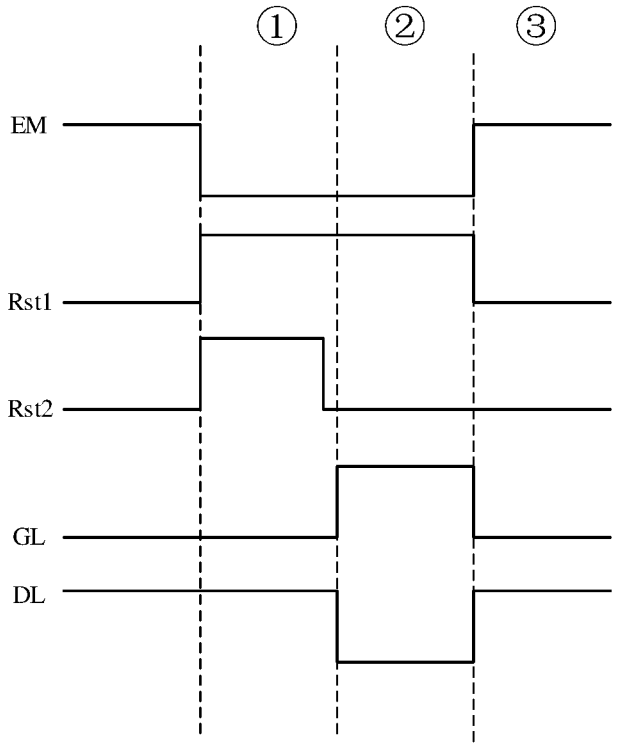
FIG. 13 is a signal timing diagram of a method of driving another pixel circuit, in accordance with some embodiments.
Figure 17:
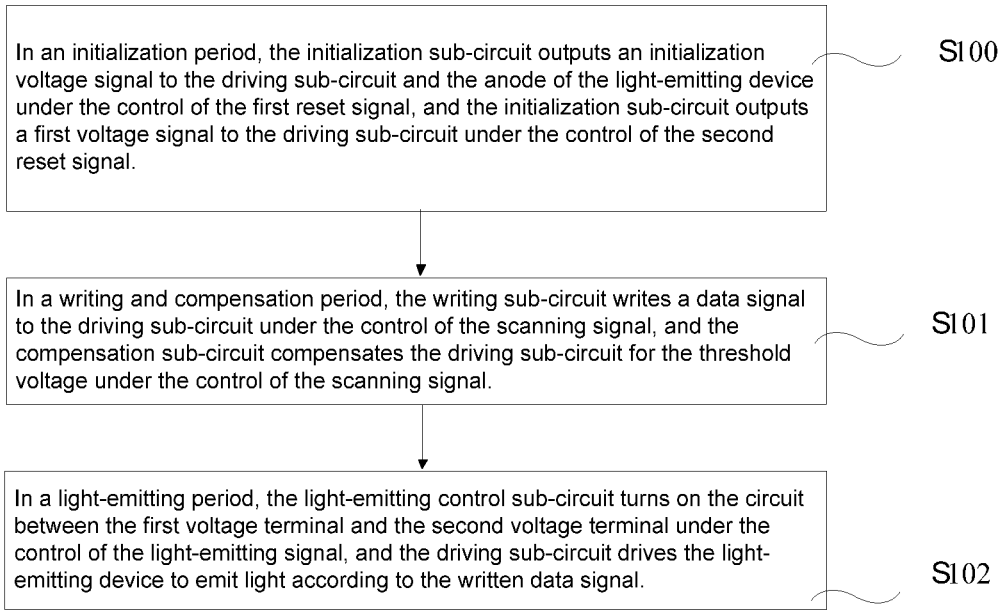
FIG. 17 is a flow diagram of a method of driving another pixel circuit, in accordance with some embodiments.

As shown in FIGS. 10, 13 and 17, some embodiments of the present disclosure provide a method of driving a pixel circuit, which is applied to the pixel circuit 100 provided in any embodiment described above. In one image frame, the method of driving the pixel circuit includes S101 and S102.

In S101, in a writing and compensation period ②, the writing sub-circuit 10 writes a data signal Vdata to the driving sub-circuit 20 under the control of the scanning signal Gn, and the compensation sub-circuit 30 compensates the driving sub-circuit 20 for the threshold voltage Vth under the control of the scanning signal Gn.

In S102, in a light-emitting period ③, the light-emitting control sub-circuit 40 turns on the circuit between the first voltage terminal ELVDD and the second voltage terminal ELVSS under the control of the light-emitting signal En, and the driving sub-circuit 20 drives the light-emitting device ED to emit light according to the written data signal Vdata.

The pixel circuit 100, to which the method of driving the pixel circuit is applied, has advantages of making the display apparatus have more uniform luminance, alleviating the aging of the light-emitting device ED, and the illumination of the sub-pixel is not affected by the voltage drop, and thus the method of driving the pixel circuit also has the advantages.

In some embodiments, as shown in FIGS. 11, 13, and 17, the pixel circuit 100 further includes an initialization sub-circuit 50. Before the scanning signal terminal GL receives the scanning signal Gn, the method of driving the pixel circuit further includes the following step.

S100, in an initialization period ①, the initialization sub-circuit 50 transmits the initialization voltage signal Vint to the driving sub-circuit 20 and the anode P of the light-emitting device ED under the control of the first reset signal $V_{R1}$, and the initialization sub-circuit 50 transmits the first voltage signal VDD to the driving sub-circuit 20 under the control of the second reset signal $V_{R2}$. In addition, in the writing and compensation period ②, the initialization sub-circuit 50 transmits the initialization voltage signal Vint to the driving sub-circuit 20 and the anode P of the light-emitting device ED under the control of the first reset signal $V_{R1}$.

In this way, in the method of driving the pixel circuit, the reset of the light-emitting device ED is continued from the beginning of the initialization period ① to the end of the writing and compensation period ②. The reset time is long, thereby reducing the number of carriers that are not recombined on the light-emitting interface inside the light-emitting device ED, and alleviating the aging thereof.

Based on the above embodiments, in some embodiments, referring to FIG. 13, in the initialization period ①, the first reset signal $V_{R1}$ and the second reset signal $V_{R2}$ are high level signals, and the scanning signal Gn and the light-emitting signal En are low level signals.

In the writing and compensation period ②, the first reset signal $V_{R1}$ and the scanning signal Gn are high level signals, and the data signal Vdata, the second reset signal $V_{R2}$, and the light-emitting signal En are low level signals.

In the light-emitting period ③, the light-emitting signal En is a high level signal, and the first reset signal $V_{R1}$, the second reset signal $V_{R2}$, and the scanning signal Gn are low level signals.

In some embodiments, in a case where the pixel circuit 100 has the structure shown in FIG. 12, referring to the signal timing diagram shown in FIG. 13, the method of driving the pixel circuit includes the following steps. The transistors in the pixel circuit 100 are N-type transistors, and the symbol "1" indicates that a high level signal is input, and the symbol "0" indicates that a low level signal is input.

In the initialization period ① of an image frame: EM=0, Rst1=1, Rst2=1, and GL=0.

Figure 14:
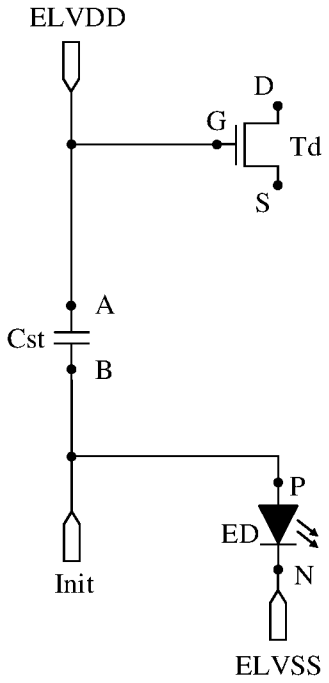
FIG. 14 is an equivalent circuit diagram of another pixel circuit in an initialization period, in accordance with some embodiments.

A high level signal is input via the first reset signal terminal Rst1, and the first transistor T1 is turned on. A high level signal is input via the second reset signal terminal Rst2, and the second transistor T2 is turned on. A low level signal is input via the scanning signal terminal GL, and the third transistor T3 and the fourth transistor T4 are turned off. A low level signal is input via the light-emitting signal terminal EM, and the fifth transistor T5 and the sixth transistor T6 are turned off. In this case, the equivalent circuit diagram of the pixel circuit 100 in the initialization period ① is as shown in FIG. 14.

The initialization voltage signal Vint input via the initialization voltage terminal Init is transmitted to the anode P of the light-emitting device ED and the second end B of the storage capacitor Cst via the first transistor T1, thereby the anode P of the light-emitting device ED is reset to alleviate the aging of the light-emitting device ED. In addition, the voltage at the second end B of the storage capacitor Cst is reset to avoid the influence of the signal of the previous image frame remaining in the storage capacitor Cst on the display image in the present image frame.

Moreover, the first voltage signal VDD input via the first voltage terminal ELVDD is transmitted to the control electrode G of the driving transistor Td, so that the voltage Vg at the control electrode G of the driving transistor Td is equal to VDD (Vg=VDD).

In this case, the voltage difference Vcst between the first end A and the second end B of the storage capacitor Cst is a difference of VDD and Vint (Vcst=VDD−Vint).

In the initialization period ①, since the fifth transistor T5 and the sixth transistor T6 are turned off, the circuit between the first voltage terminal ELVDD and the second voltage terminal ELVSS is in an off state, and the light-emitting device ED is in a non-illuminated state.

In the writing and compensation period ② of the image frame: EM=0, Rst1=1, Rst2=0, and GL=1.

Figure 15:
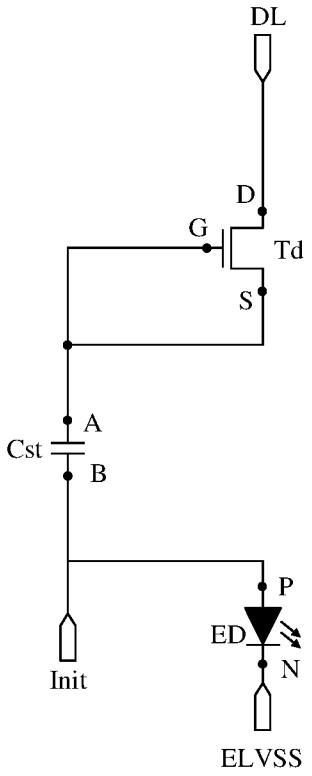
FIG. 15 is an equivalent circuit diagram of another pixel circuit in a writing and compensation period, in accordance with some embodiments.

A low level signal is input via the second reset signal terminal Rst2, and the second transistor T2 is turned off. A high level signal is input via the first reset signal terminal Rst1, and the first transistor T1 remains in an on state. A high level signal is input via the scanning signal terminal GL, and the third transistor T3 and the fourth transistor T4 are turned on. A low level signal is input via the light-emitting signal terminal EM, and the fifth transistor T5 and the sixth transistor T6 are turned off. In this case, the equivalent circuit diagram of the above pixel circuit 100 in the writing and compensation period ② is as shown in FIG. 15.

The fourth transistor T4 is turned on, and the second electrode S and the control electrode G of the driving transistor Td are electrically connected to each other. In this case, since the voltage at the control electrode G of the driving transistor Td is still the voltage in the previous period, which is equal to VDD, the driving transistor Td is equivalent to a turned-on diode. Further, since the third transistor T3 is turned on, the data signal Vdata from the data signal terminal DL is transmitted to the first electrode D of the driving transistor Td via the third transistor T3. The voltage of the data signal Vdata is low relative to the voltage at the first end A of the storage capacitor Cst. Therefore, the charge stored in the storage capacitor Cst flows towards the data signal terminal DL through the turned-on driving transistor Td, that is, the storage capacitor Cst is discharged towards the data signal terminal DL.

During the discharge of the storage capacitor Cst, the potential at the first end A of the storage capacitor Cst is continuously decreased, that is, the voltage Vg at the control electrode G of the driving transistor Td is continuously decreased. When the voltage difference Vgs between the control electrode G and the second electrode S of the driving transistor Td is decreased to be equal to the threshold voltage Vth thereof, the driving transistor Td is turned off, and the storage capacitor Cst stops being discharged. In this case, the voltage at the control electrode G of the driving transistor Td is a sum of Vdata and Vth (Vg=Vdata+Vth).

In addition, the first transistor T1 is controlled to be in an on state through the first reset signal $V_{R1}$, and the potential at the second end B of the storage capacitor Cst is Vint.

In this case, the voltage difference Vcst between the first end A and the second end B of the storage capacitor Cst is a difference of a sum of Vdata and Vth and Vint (Vcst=Vdata+Vth−Vint).

Further, in the writing and compensation period ②, the first transistor T1 is controlled to be in an on state through the first reset signal $V_{R1}$. The initialization voltage Vint is intput via the initialization voltage terminal Init, and the anode P of the light-emitting device ED is still be reset in the writing and compensating period ②, thereby extending the reset time of the anode P of the light-emitting device ED, and further alleviating the aging of the light-emitting device ED.

In the light-emitting period ③ of the image frame, as shown in FIG. 4: EM=1, Rst1=0, Rst2=0, and GL=0.

Figure 16:
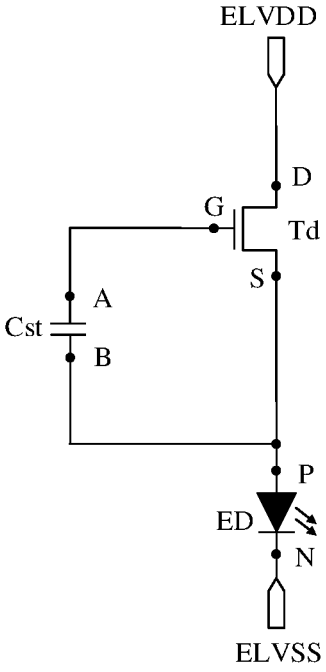
FIG. 16 is an equivalent circuit diagram of another pixel circuit in a light-emitting period, in accordance with some embodiments.

A low level signal is input via the first reset signal terminal Rst1, and the first transistor T1 is turned off. A low level signal is input via the second reset signal terminal Rst2, and the second transistor T2 is turned off. A low level signal is input via the scanning signal terminal GL, and the third transistor T3 and the fourth transistor T4 are turned off. A high level signal is input via the light-emitting signal terminal EM, and the fifth transistor T5 and the sixth transistor T6 are turned on. In this case, the equivalent circuit diagram of the above pixel circuit 100 in the light-emitting period ③ is as shown in FIG. 16.

The first end A of the storage capacitor Cst is electrically connected to the control electrode G of the driving transistor Td, and the second end B of the storage capacitor Cst is electrically connected to the second electrode S of the driving transistor Td. In this case, the voltage difference Vgs between the control electrode G and the second electrode S of the driving transistor Td is equal to the voltage difference Vcst between the first end A and the second end B of the storage capacitor Cst, that is, both the Vgs and Vcst are equal to a difference between a sum of Vdata and Vth and Vint (Vgs=Vcst=Vdata+Vth−Vint).

In addition, the first voltage signal VDD is able to ensure that the voltage difference Vds between the first electrode D and the second electrode S of the driving transistor Td is greater than a difference between Vgs and Vth (Vds>Vgs−Vth), and thus the driving transistor Td is in a saturated state.

In this way, the circuit between the first voltage terminal ELVDD and the second voltage terminal ELVSS is turned on, and the formula of the driving current I for driving the light-emitting device ED to emit light is:

$$I=K(Vgs-Vth)^2=K(V\text{data}+Vth-V\text{int}-Vth)^2=K(V\text{data}-V\text{int})^2 \quad (1).$$

Where K is a factor related to the manufacturing process of the driving transistor Td.

As can be seen from the formula (1), the driving current I for driving the light-emitting device ED to emit light is independent of the threshold voltage Vth of the driving transistor Td, and thus the driving current I is not affected by the threshold voltage Vth of the driving transistor Td. Therefore, the uniformity of the driving currents I of the light-emitting device ED flowing through the sub-pixels is improved, thereby making the luminance of the display apparatus more uniform and improving the display effect thereof.

In addition, the sub-pixels located in different areas in the display apparatus have resistance drops even if the distances from the sub-pixels to the first voltage terminal ELVDD or the second voltage terminal ELVSS are different, but since the driving current I for driving the light-emitting device ED to emit light is independent of the first voltage signal VDD and the second voltage signal VSS, the above resistance drops do not affect the driving currents I in the sub-pixels, thereby improving the uniformity of the luminance of the display apparatus.

As can be seen from the above formula (1), in a case where the voltage of the initialization voltage signal Vint is constant, the driving current I is related to the data signal Vdata written to the driving transistor Td. Therefore, in some embodiments, by adjusting the data signal Vdata from the data signal terminal L, the display apparatus may display an image with different gray scales.

A person of ordinary skill in the art can understand that: a related hardware may be controlled by a program to implement all or part of the steps in the method embodiments described above. The program may be stored in a computer-readable storage medium. When the program is executed by the hardware (for example, a processor), the steps included in the method embodiments above are performed. The storage medium includes various media that can store program codes, such as a read-only memory (ROM), a random-access memory (RAM), a magnetic disk, or an optical disk.

The above embodiments are merely some specific embodiments of the present disclosure, but the protection scope of the present disclosure is not limited thereto. Any person skilled in the art could readily conceive of changes or replacement within the technical scope of the present disclosure, which shall all be included in the protection scope of the present disclosure. Therefore, the protection scope of the present disclosure shall be determined by the protection scope of the claims.

What is claimed is:

1. A pixel circuit, comprising a writing sub-circuit, a driving sub-circuit, a compensation sub-circuit, a light-emitting control sub-circuit and an initialization sub-circuit, wherein the writing sub-circuit is electrically connected to a data signal terminal, a scanning signal terminal, and the driving sub-circuit, and in a writing and compensation period in an image frame the writing sub-circuit is configured to write a data signal from the data signal terminal to the driving sub-circuit in response to a scanning signal from the scanning signal terminal;

the compensation sub-circuit is electrically connected to the scanning signal terminal and the driving sub-circuit, and in the writing and compensation period in the image frame the compensation sub-circuit is configured to compensate the driving sub-circuit for a threshold voltage in response to the scanning signal;

the light-emitting control sub-circuit is electrically connected to a light-emitting signal terminal and a second voltage terminal, and is electrically connected to a first voltage terminal through a light-emitting device, and in a light-emitting period in the image frame the light-emitting control sub-circuit is configured to turn on a circuit between the first voltage terminal and the second voltage terminal in response to a light-emitting signal from the light-emitting signal terminal;

the driving sub-circuit is electrically connected to the light-emitting control sub-circuit and the light-emitting device, and in the light-emitting period in the image frame the driving sub-circuit is configured to drive the light-emitting device to emit light according to the written data signal; and the initialization sub-circuit is electrically connected to a first reset signal terminal, a second reset signal terminal, an initialization voltage terminal, the second voltage terminal, the driving sub-circuit, and the light-emitting device, wherein in an initialization period in the image frame and before the scanning signal is received by the scanning signal terminal, the initialization sub-circuit is configured to transmit an initialization voltage signal from the initialization voltage terminal to the driving sub-circuit and the light-emitting device in response to a first reset signal from the first reset signal terminal, and to transmit a second voltage signal from the second voltage terminal to the driving sub-circuit in response to a second reset signal from the second reset signal terminal; and in the writing and compensation period in the image frame and before the scanning signal is received by the scanning signal terminal, the initialization sub-circuit is configured to transmit the initialization voltage signal to the driving sub-circuit and the light-emitting device in response to the first reset signal.

2. The pixel circuit of claim 1, wherein the initialization sub-circuit is configured to receive an initialization voltage signal which is from the initialization voltage terminal and has a voltage equal to or approximately equal to a voltage of a first voltage signal from the first voltage terminal.

3. The pixel circuit of claim 1, wherein the initialization sub-circuit includes a first transistor and a second transistor;

a control electrode of the first transistor is electrically connected to the first reset signal terminal, a first electrode of the first transistor is electrically connected to the initialization voltage terminal, and a second electrode of the first transistor is electrically connected to the driving sub-circuit and a cathode of the light-emitting device; and a control electrode of the second transistor is electrically connected to the second reset signal terminal, a first electrode of the second transistor is electrically connected to the second voltage terminal, and a second electrode of the second transistor is electrically connected to the driving sub-circuit.

4. The pixel circuit of claim 1, wherein the driving sub-circuit includes a driving transistor and a storage capacitor;

a control electrode of the driving transistor is electrically connected to a second end of the storage capacitor, a first electrode of the driving transistor is electrically connected to the writing sub-circuit and the light-emitting control sub-circuit, and a second electrode of the driving transistor is electrically connected to the light-emitting control sub-circuit and the compensation sub-circuit; and a first end of the storage capacitor is electrically connected to a cathode of the light-emitting device.

5. The pixel circuit of claim 1, wherein the writing sub-circuit includes a third transistor; and a control electrode of the third transistor is electrically connected to the scanning signal terminal, a first electrode of the third transistor is electrically connected to the data signal terminal, and a second electrode of the third transistor is electrically connected to the driving sub-circuit.

6. The pixel circuit of claim 1, wherein the compensation sub-circuit includes a fourth transistor; and a control electrode of the fourth transistor is electrically connected to the scanning signal terminal, and a first electrode and a second electrode of the fourth transistor are electrically connected to the driving sub-circuit.

7. The pixel circuit of claim 1, wherein the light-emitting control sub-circuit includes a fifth transistor and a sixth transistor;

a control electrode of the fifth transistor is electrically connected to the light-emitting signal terminal, a first electrode of the fifth transistor is electrically connected to the driving sub-circuit, and a second electrode of the fifth transistor is electrically connected to the second voltage terminal; and a control electrode of the sixth transistor is electrically connected to the light-emitting signal terminal, a first electrode of the sixth transistor is electrically connected to a cathode of the light-emitting device, and a second electrode of the sixth transistor is electrically connected to the driving sub-circuit.

8. The pixel circuit of claim 1, wherein the initialization sub-circuit includes a first transistor and a second transistor, the writing sub-circuit includes a third transistor, the driving sub-circuit includes a driving transistor and a storage capacitor, the compensation sub-circuit includes a fourth transistor, and the light-emitting control sub-circuit includes a fifth transistor and a sixth transistor, wherein a control electrode of the first transistor is electrically connected to the first reset signal terminal, a first electrode of the first transistor is electrically connected to the initialization voltage terminal, and a second electrode of the first transistor is electrically connected to a first end of the storage capacitor and a cathode of the light-emitting device;

a control electrode of the second transistor is electrically connected to the second reset signal terminal, a first electrode of the second transistor is electrically connected to the second voltage terminal, and a second electrode of the second transistor is electrically connected to a second end of the storage capacitor;

a control electrode of the third transistor is electrically connected to the scanning signal terminal, a first electrode of the third transistor is electrically connected to the data signal terminal, and a second electrode of the third transistor is electrically connected to a first electrode of the driving transistor;

a control electrode of the driving transistor is electrically connected to the second end of the storage capacitor, the first electrode of the driving transistor is electrically connected to a second electrode of the sixth transistor, and a second electrode of the driving transistor is electrically connected to a first electrode of the fifth transistor;

the first end of the storage capacitor is electrically connected to the cathode of the light-emitting device;

a control electrode of the fourth transistor is electrically connected to the scanning signal terminal, a first electrode of the fourth transistor is electrically connected to the second electrode of the driving transistor, and a second electrode of the fourth transistor is electrically connected to the second end of the storage capacitor;

a control electrode of the fifth transistor is electrically connected to the light-emitting signal terminal, and a second electrode of the fifth transistor is electrically connected to the second voltage terminal; and a control electrode of the sixth transistor is electrically connected to the light-emitting signal terminal, and a first electrode of the sixth transistor is electrically connected to the cathode of the light-emitting device.

9. The pixel circuit of claim 8, wherein the first to sixth transistors, and the driving transistor are P-type transistors.

10. The pixel circuit of claim 1, wherein the driving sub-circuit is configured in such a way that a voltage of a second voltage signal received by the driving sub-circuit from the second voltage terminal is less than a voltage of a data signal received by the driving sub-circuit from the data signal terminal.

11. A display panel, comprising a plurality of sub-pixels, wherein at least one sub-pixel includes the pixel circuit according to claim 1 and a light-emitting device that is electrically connected to the pixel circuit.

12. The display panel of claim 11, wherein the light-emitting device is a self-luminous device.

13. A display apparatus, comprising the display panel of claim 11.

14. A method of driving the pixel circuit of claim 1, in an image frame, the method comprising:

in a writing and compensation period:

writing, by the writing sub-circuit, a data signal to the driving sub-circuit in response to a scanning signal, and compensating, by the compensation sub-circuit, the driving sub-circuit for a threshold voltage in response to the scanning signal; and in a light-emitting period:

turning on, by the light-emitting control sub-circuit, a circuit between the first voltage terminal and the second voltage terminal in response to a light-emitting signal, and driving, by the driving sub-circuit, the light-emitting device to emit light in response to the written data signal, wherein before the scanning signal is received by the scanning signal terminal, the method further comprises:

in an initialization period:

transmitting, by the initialization sub-circuit, an initialization voltage signal to the driving sub-circuit and the light-emitting device in response a first reset signal, and transmitting, by the initialization sub-circuit, a second voltage signal to the driving sub-circuit in response to a second reset signal; and in the writing and compensation period:

transmitting, by the initialization sub-circuit, the initialization voltage signal to the driving sub-circuit and the light-emitting device in response to the first reset signal.

15. The method of claim 14, wherein in the initialization period, the first reset signal and the second reset signal are low level signals, and the scanning signal and the light-emitting signal are high level signals;

in the writing and compensation period, the first reset signal and the scanning signal are low level signals, and the data signal, the second reset signal, and the light-emitting signal are high level signals; and in the light-emitting period, the light-emitting signal is a low level signal, and the first reset signal, the second reset signal, and the scanning signal are high level signals.

* * * * *